US006513903B2

(12) United States Patent
Sharma et al.

(10) Patent No.: US 6,513,903 B2
(45) **Date of Patent: *Feb. 4, 2003**

(54) INK JET PRINT HEAD WITH CAPILLARY FLOW CLEANING

(75) Inventors: Ravi Sharma, Fairport, NY (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/750,993

(22) Filed: Dec. 29, 2000

(65) Prior Publication Data

US 2002/0085059 A1 Jul. 4, 2002

(51) Int. Cl.[7] ..... B41J 2/165

(52) U.S. Cl. ..... 347/28

(58) Field of Search ..... 347/28, 22, 24, 347/27

(56) References Cited

U.S. PATENT DOCUMENTS

| | | | | |
|---|---|---|---|---|
| 3,373,437 | A | 3/1968 | Sweet et al. | 347/75 |
| 3,416,153 | A | 12/1968 | Hertz et al. | 347/75 |
| 3,705,043 | A | 12/1972 | Zabiak | 347/75 |
| 3,776,642 | A | 12/1973 | Anson et al. | 347/75 |
| 3,846,141 | A | 11/1974 | Ostergren et al. | 347/75 |
| 3,870,528 | A | 3/1975 | Edds et al. | 347/75 |
| 3,878,519 | A | 4/1975 | Eaton | 347/75 |
| 3,889,269 | A | 6/1975 | Meyer et al. | 347/75 |
| 3,903,034 | A | 9/1975 | Zabiak et al. | 347/75 |
| 4,346,387 | A | 8/1982 | Hertz | 347/75 |
| 4,591,870 | A | 5/1986 | Brau et al. | 347/25 |
| 4,600,928 | A | 7/1986 | Braun et al. | 347/27 |
| 4,849,769 | A | 7/1989 | Dressler | 347/75 |
| 4,951,066 | A | 8/1990 | Terasawa et al. | 347/30 |
| 4,959,673 | A | 9/1990 | Noda | 347/75 |
| 4,970,535 | A | 11/1990 | Oswald et al. | 347/25 |
| 5,115,250 | A | 5/1992 | Harmon et al. | 347/33 |
| 5,148,746 | A | 9/1992 | Fuller et al. | 101/142 |
| 5,151,715 | A | 9/1992 | Ward et al. | 347/33 |
| 5,202,702 | A | 4/1993 | Terasawa et al. | 347/30 |
| 5,287,126 | A | 2/1994 | Quate | 347/25 |
| 5,305,015 | A | 4/1994 | Schantz et al. | 347/75 |
| 5,350,616 | A | 9/1994 | Pan et al. | 347/75 |
| 5,396,271 | A | 3/1995 | Premnath | 347/75 |
| 5,412,411 | A | 5/1995 | Anderson | 347/28 |
| 5,426,458 | A | 6/1995 | Wenzel et al. | 347/75 |
| 5,431,722 | A | 7/1995 | Yamashita et al. | 347/75 |
| 5,489,927 | A | 2/1996 | Harmon | 347/33 |
| 5,500,660 | A | 3/1996 | Childers et al. | 347/33 |
| 5,539,435 | A | 7/1996 | Uchida et al. | 347/33 |
| 5,555,461 | A | 9/1996 | Ackerman | 347/33 |

(List continued on next page.)

FOREIGN PATENT DOCUMENTS

| | | | |
|---|---|---|---|
| DE | 3825045 | A1 | 7/1988 |
| EP | 1016532 | A2 | 12/1999 |
| EP | 1052099 | A1 | 4/2000 |
| GB | 2 280 149 | A | 6/1993 |
| JP | 59012857 | | 7/1982 |
| JP | 58096563 | | 1/1983 |

*Primary Examiner*—Shih-wen Hsieh
(74) *Attorney, Agent, or Firm*—Roland R. Schindler, II

(57) ABSTRACT

The present invention resides in a self-cleaning printer with a print head having an orifice plate defining an ink jet orifice, a cleaning orifice and a drain orifice. The orifice plate further defines an outer surface between the orifices. A source of pressurized cleaning fluid is connected to the cleaning orifice and a fluid return is connected to the drain orifice for storing used cleaning fluid. A cleaning surface is disposed adjacent to and separate from the outer surface to define a capillary fluid flow path from the cleaning orifice across the ink jet orifice and to the drain orifice. During cleaning, the source of pressurized cleaning fluid discharges a flow of a cleaning fluid into the capillary fluid flow path and pressurized cleaning fluid from the capillary flow path passes through the drain orifice and into the fluid return.

52 Claims, 21 Drawing Sheets

U.S. PATENT DOCUMENTS

| | | | | |
|---|---|---|---|---|
| 5,570,117 | A | 10/1996 | Karambelas et al. | 347/33 |
| 5,574,485 | A | 11/1996 | Anderson et al. | 347/27 |
| 5,583,548 | A | 12/1996 | Kearns | 347/33 |
| 5,612,722 | A | 3/1997 | Francis et al. | 347/33 |
| 5,614,930 | A | 3/1997 | Osborne et al. | 347/33 |
| 5,706,038 | A | 1/1998 | Jackson et al. | 347/33 |
| 5,717,445 | A | 2/1998 | Kida et al. | 347/33 |
| 5,725,647 | A | 3/1998 | Carlson et al. | 106/31.86 |
| 5,738,716 | A | 4/1998 | Santilli et al. | 106/31.77 |
| 5,745,133 | A | 4/1998 | Hendricks et al. | 347/33 |
| 5,774,140 | A | 6/1998 | English | 347/33 |
| 5,815,176 | A | 9/1998 | Rotering | 347/33 |
| 5,914,734 | A | 6/1999 | Rotering et al. | 347/28 |
| 5,949,448 | A | 9/1999 | Man et al. | 347/33 |
| 5,997,127 | A | 12/1999 | Fassler et al. | 347/28 |
| 6,017,110 | A | 1/2000 | Jackson | 347/33 |
| 6,082,848 | A | 7/2000 | Taylor | 347/35 |
| 6,132,026 | A | 10/2000 | Taylor et al. | 347/32 |
| 6,142,601 | A | 11/2000 | Sharma et al. | 347/28 |
| 6,168,258 | B1 | 1/2001 | Lou et al. | 347/33 |
| 6,189,999 | B1 | 2/2001 | Pham et al. | 347/33 |
| 6,283,575 | B1 * | 9/2001 | Hawkins et al. | 347/28 |

* cited by examiner

INK JET PRINT HEAD WITH CAPILLARY FLOW CLEANING

CROSS REFERENCE TO RELATED APPLICATIONS

Reference is made to commonly assigned copending U.S. patent application Ser. No. 09/751,620 filed Dec. 29, 2000, entitled SELF-CLEANING PRINTER AND PRINT HEAD AND METHOD FOR MANUFACTURING SAME, by Sharma et al.; Ser. No. 09/407,451, filed Sep. 28, 1999, entitled A SELF-CLEANING INK JET PRINTER SYSTEM WITH REVERSE FLUID FLOW AND METHOD OF ASSEMBLING THE PRINTER SYSTEM, by Sharma et al.

FIELD OF THE INVENTION

This invention relates to a printer having self-cleaning features and a print head for use in printers having a cleaning feature.

BACKGROUND OF THE INVENTION

Ink jet printers produce images on a receiver by ejecting ink droplets onto the receiver in an imagewise fashion. The advantages of non-impact, low-noise, low energy use, and low cost operation in addition to the capability of the printer to print on a receiver medium such as a plain paper are largely responsible for the wide acceptance of ink jet printers in the marketplace.

Many types of ink jet printers have been developed. One form of ink jet printer is the "continuous" ink jet printer. Continuous ink jet printers generate a stream of ink droplets during printing. Certain droplets are permitted to strike a receiver medium while other droplets are diverted. In this way, the continuous ink jet printer can controllably define a flow of ink droplets onto the receiver medium to form an image. One type of continuous ink jet printer uses electrostatic charging tunnels that are placed close to the stream of ink droplets. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the receiver.

Another type of ink jet printer is the "on demand" ink jet printer. "On demand" ink jet printers eject ink droplets only when needed to form the image. In one form of "on demand" ink jet printer, a plurality of ink jet nozzles is provided and a pressurization actuator is provided for every nozzle. The pressurization actuators are used to produce the ink jet droplets. In this regard, either one of two types of actuators are commonly used: heat actuators and piezoelectric actuators. With respect to heat actuators, a heater is disposed in the ink jet nozzle and heats the ink. This causes a quantity of the ink to phase change into a gaseous bubble and raise the internal ink pressure sufficiently for an ink droplet to be expelled onto the recording medium.

With respect to piezoelectric actuators, a piezoelectric material is provided for every nozzle. The piezoelectric material possesses piezoelectric properties such that an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate. When these materials are used in an ink jet print head, they apply mechanical stress upon the ink in the print head to cause an ink droplet to be ejected from the print head.

Inks for high speed ink jet printers, whether of the "continuous" or "on demand" type, must have a number of special characteristics. For example, the inks should incorporate a nondrying characteristic, so that drying of ink in the ink ejection chamber is hindered or slowed to such a state that by occasional "spitting" of ink droplets, the cavities and corresponding orifices are kept open.

Moreover, the ink jet print head is exposed to the environment where the ink jet printing occurs. Thus, the previously mentioned orifices and print head surface are exposed to many kinds of airborne particulates. Particulate debris may accumulate on the print head surface surrounding the orifices and may accumulate in the orifices and chambers themselves. Also, ink may combine with such particulate debris to form an interference burr that blocks the orifice or that alters surface wetting to inhibit proper formation of the ink droplet. Of course, the particulate debris should be cleaned from the surface and orifice to restore proper droplet formation.

Ink jet print head cleaners are known. An ink jet print head cleaner is disclosed in U.S. Pat. No. 4,970,535 titled "In Jet Print Head Face Cleaner" issued Nov. 13, 1990 in the name of James C. Oswald. This patent discloses an ink jet print head face cleaner that provides a controlled air passageway through an enclosure formed against the print head face. Air is directed through an inlet into a cavity in the enclosure. The air that enters the cavity is directed past ink jet apertures on the head face and out an outlet. A vacuum source is attached to the outlet to create a sub-atmospheric pressure in the cavity. A collection chamber and removable drawer are positioned below the outlet to facilitate disposal of removed ink. However, the use of heated air is not a particularly effective medium for removing dried particles from the print head surface. Also, the use of heated air may damage fragile electronic circuitry that may be present on the print head surface.

Cleaning systems that use a cleaning fluid such as an alcohol or other solvent have been found to be particularly effective. This is because the cleaning fluid helps to dissolve the ink and other contaminants that have dried to the surface of the print head. One way to use a cleaning fluid to clean a print head is known as wet wiping. In wet wiping, cleaning fluid is applied to the print head and a wiper is used to clean the cleaning fluid and contaminants from the print head. Examples of various wet wiping embodiments are found in Rotering et al. U.S. Pat. No. 5,914,734. Each of these embodiments uses a cleaning station to apply a metered amount of cleaning fluid to the print head and to wipe cleaning fluid and contaminants from the print head. However, wipers can damage the fragile electronic circuitry and Micro Electro-Mechanical Systems (MEMS) that may be present on the print head surface. Further, the wiper itself may leave contaminants on the surface of the print head that can obstruct the orifices.

Thus, it is preferred to clean the surface of a print head by applying a cleaning fluid to the print head, using the cleaning fluid to clean the print head and removing the cleaning fluid from the print head all without contact with the print head.

One ink jet print head cleaner that uses a solvent to clean portions of the print head in a non-contact manner is disclosed in commonly assigned U.S. Pat. No. 4,600,928 by Braun et al. This patent is directed to cleaning components within an ink jet print head of a continuous type. In Braun et al., an orifice plate is to form ink droplets. These ink droplets are charged and are passed by a catcher that is selectively charged to attract certain droplets. The droplets that are permitted to pass the catcher are permitted to strike a media During cleaning, a fluid meniscus of ink is statically supported along an axis that is generally normal to the orifice plate to form a meniscus between the charge plate, orifice plate and/or the catcher. This meniscus is ultrasonically excited to clean the orifice plate and charge plate and catcher. The ink from the meniscus is then ejected into a sump that is located at a cleaning station.

U.S. Pat. No. 5,574,485, to Anderson et al. describes a cleaning station for cleaning a print head by scanning a liquid wiper across the orifices of the print head. In Anderson, et al. the cleaning station comprises a cleaning fluid jet and a pair of vacuum orifices flanking the jet. During cleaning the jet is moved into a position that is proximate to the print head. The jet is separated from the print head by a distance, "t". In Anderson et al., "t" is defined as being "about 10 mil", 0.25 mm, or 250 microns. When the jet is so positioned, the jet defines a flow of a cleaning fluid at the print head. A meniscus bridge of cleaning fluid is formed between the print head and the jet. Anderson et al., teaches that the print head is cleaned by scanning this meniscus bridge along the surface of the print head and by agitating the meniscus bridge using an ultrasonic vibrator. Cleaning fluid and any entrained contaminants are removed from the surface by use of the vacuum suction through the vacuum orifices.

Thus, Braun et al. teaches that a print head can be cleaned in a non-contact manner using a static fluid meniscus and Anderson et al., teaches cleaning a print head using a meniscus that is scanned along the surface of a print head.

It will be recognized that it is often necessary to use mechanical force to clean contaminant that has dried to the surface of a print head or that is positioned within an ink jet orifice. Where a cleaning fluid is used to clean a print head in a non-contact fashion, the force used to remove debris from the print head and ink jet orifices comes from fluid pressure applied in the form of a flow of cleaning fluid. However, the prior art does not teach a self-cleaning printer or self-cleaning print head that uses a pressurized flow of cleaning fluid to apply force to remove contaminant from the print head.

Further, the prior art does not teach a non-contact method for containing a pressurized flow of a cleaning fluid within a defined flow path during cleaning.

Thus, what is needed is a self-cleaning printer and self-cleaning print head that use a pressurized flow of cleaning fluid to clean a print head and ink jet orifices defined on the print head. What is also needed is a self-cleaning printer and self-cleaning print head that provide a non-contact method for containing a pressurized flow of a cleaning fluid within a defined fluid flow path during cleaning.

SUMMARY OF THE INVENTION

The present invention resides in a self-cleaning printer with a print head having an orifice plate defining an ink jet orifice, a cleaning orifice and a drain orifice. The orifice plate further defines an outer surface between the orifices. A source of pressurized cleaning fluid is connected to the cleaning orifice and a fluid return is connected to the drain orifice for storing used cleaning fluid. A cleaning surface is disposed adjacent to and separate from the outer surface to define a capillary fluid flow path from the cleaning orifice across the ink jet orifice and to the drain orifice. During cleaning, the source of pressurized cleaning fluid discharges a flow of a cleaning fluid into the capillary fluid flow path and pressurized cleaning fluid from the capillary flow path passes through the drain orifice and into the fluid return.

The present invention also resides in a self-cleaning print head with a print head body having an orifice plate defining an ink jet orifice, a cleaning orifice and a drain orifice. The orifice plate further defines an outer surface between the orifices. A source of pressurized cleaning fluid is connected to the cleaning orifice and a fluid return is connected to the drain orifice for storing used cleaning fluid. A cleaning surface is disposed adjacent to and separate from the outer surface for forming a space between the cleaning member and the print head. During cleaning operations, the source of pressurized cleaning fluid discharges a flow of a cleaning fluid into the capillary flow path and pressurized cleaning fluid from the capillary fluid flow path passes through the drain orifice and into the fluid return.

BRIEF DESCRIPTION OF THE DRAWINGS

While the specification concludes with claims particularly pointing out and distinctly claiming the subject matter of the present invention, it is believed that the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
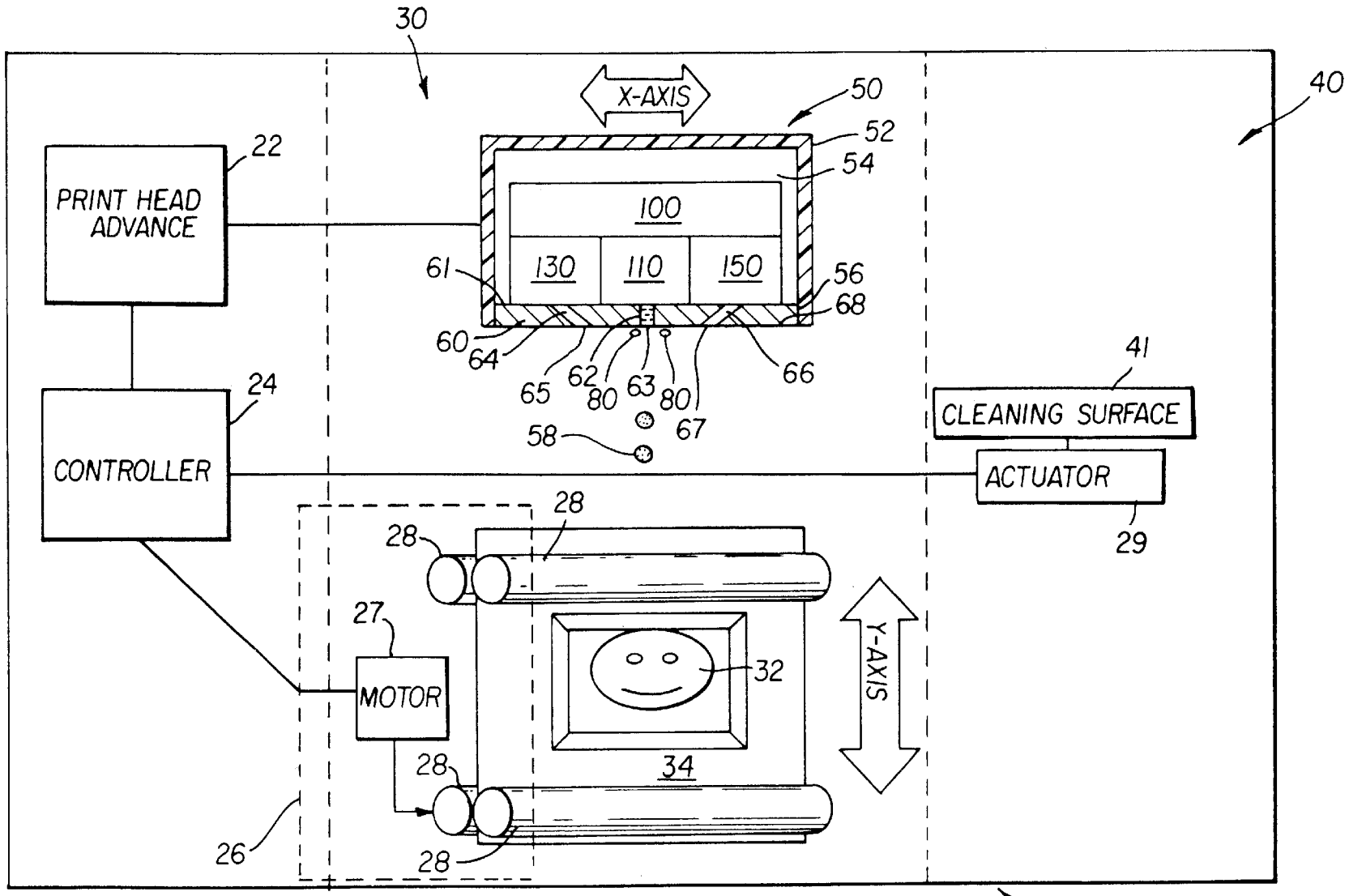
FIG. 1 shows an embodiment of the self-cleaning printer of the present invention wherein the printer is operated in a printing mode.

FIG. 1 shows a first embodiment of the self-cleaning printer of the present invention generally referred to as 20. Printer 20 prints images on a media 34, which may be a reflective-type receiver (e.g. paper) or a transmissive-type receiver (e.g. transparency). Printer 20 comprises a cabinet 21 containing a print head 50, a media advance 26 and a print head advance 22.

As is shown in FIG. 1, Y-axis displacement of media 34 relative to print head 50 is provided by media advance 26. The media advance 26 can comprise any number of well-known systems for moving media 34 within a printer 20, including a motor 27 driving pinch rollers 28, a motorized platen roller (not shown) or other well-known systems for paper and media movement. A print head advance 22 is fixed to print head 50 and translates print head 50 along an X-axis relative to media 34. Print head advance 22 can comprise any of a number of systems for moving print head 50 relative to a media 34 including among others a motorized belt arrangement (not shown) and a screw driven arrangement (not shown).

Controller 24 controls the operation of the print head advance 22 and media advance 26 and, thereby, can position the print head 50 at any X-Y coordinate relative to the media 34 for printing. For this purpose, controller 24 may be a model "CompuMotor" controller available from Parker Hannifin, Incorporated located in Rohmert Park, Calif. Controller 50 is preferably disposed within cabinet 21.

Print head 50 comprises print head body 52. Print head body 52 can comprise any of a box, housing, closed frame, or continuous surface or other rigid enclosure defining an interior chamber 54. A fluid flow system 100 is defined, at least in part, within interior chamber 54. The print head body 52 can be fixed to the media advance 27 for motion with the media advance 27. The media advance 26 can also define a holder (not shown) that moves with the media advance 26 and is shaped to receive and hold the print head body 52. It will be recognized that the print head body 52 can be defined in many shapes and sizes and that the shape and size of the print head body 52 will be defined by the space and functional requirements of the printer 20 into which the print head 50 is installed.

An orifice plate 60 is provided. Orifice plate 60 can be formed from a surface on the print head body 52. Alternatively, in the embodiment shown in FIGS. 1 and 2, print head body 52 defines an opening 56 into which orifice plate 60 is fixed. Orifice plate 60 can be made from a thin and flexible material such as nickel. Where such a flexible orifice plate 60 is used, structural member (not shown) is provided to support the orifice plate 60. Alternatively, orifice plate 60 can be made from a rigid material such as a silicon, a polymer or like material. The orifice plate 60 defines a fluid containment surface 61, and an outer surface 68. When orifice plate 60 is fixed in opening 56, outer surface 68 is directed toward media 34 while fluid containment surface 61 is directed toward interior chamber 54. Three passageways are defined between the fluid containment surface 61 and outer surface 68: an ink jet passageway 62 defining an ink jet orifice 63, a cleaning fluid passageway 64 defining a cleaning orifice 65 and a drain passageway 66 defining a drain orifice 67.

Fluid flow system 100 comprises a supply of pressurized ink 110, a supply of pressurized cleaning fluid 130, and a fluid return 150. Fluid connections are defined between supply 110 and ink jet passageway 62, between supply 130 and cleaning fluid passageway 64 and between the fluid return 150 and drain fluid passageway 66. During normal printing operations, fluid flow system 100 causes controlled amounts of ink 114 to flow to the ink jet orifice 63 and form ink droplets 58. Images 32 are formed on the media 34 by depositing ink droplets 58 on the media 32 in particular concentrations at particular X-Y coordinates.

It has been observed that during printing operations, outer surface 68 may become fouled by contaminant 80. Contaminant 80 may be, for example, an oily film or particulate matter residing on outer surface 68. The particulate matter may be particles of dirt, dust, metal and/or encrustations of dried ink, or the like. The oily film may be grease, or the like. In this regard, contaminant 80 may partially or completely obstruct ink jet orifice 63. The presence of contaminant 80 is undesirable because when contaminant 80 completely obstructs orifice 63 ink droplets 58 cannot exit orifice 63. Also, when contaminant 80 partially obstructs orifice 63, ink droplets 58 may be deposited at an incorrect or unintended X-Y coordinate on the media 32. In this manner, such complete or partial obstruction of orifice 63 leads to unwanted printing artifacts such as "banding", a highly undesirable result. The presence of contaminant 80 may alter surface wetting and therefore inhibit proper formation of droplets 58 on surface 68 near orifice 63 thereby leading to such printing artifacts. Therefore, it is desirable to clean (i.e., remove) contaminant 80 to avoid printing artifacts.

Figure 2:
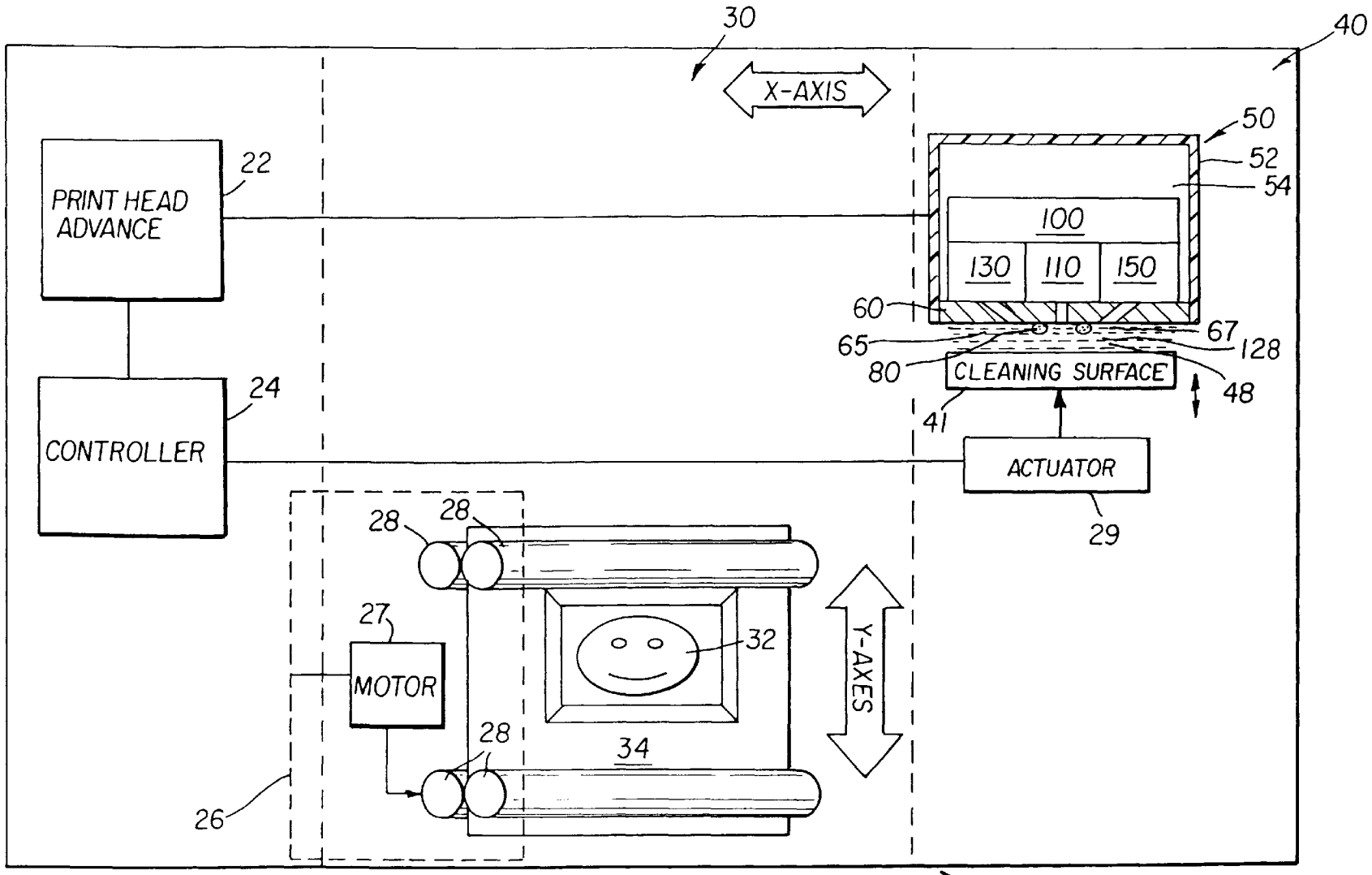
FIG. 2 shows the embodiment of FIG. 1, wherein the self-cleaning printer is operated in a self-cleaning mode.

FIG. 2 shows a diagram of the printer 20 operated to clean contaminant 80 from the surface 68 and ink jet orifice 63. When the controller 24 initiates a cleaning operation, the print head 50 is moved into a cleaning area 40 defined along the X-axis but separated from printing area 30. A cleaning surface 41 and an actuator 29 are located within cleaning area 40. As is shown in FIG. 2, during cleaning, actuator 29 is used to position cleaning surface 41 proximate to outer surface 68.

Figure 3A:
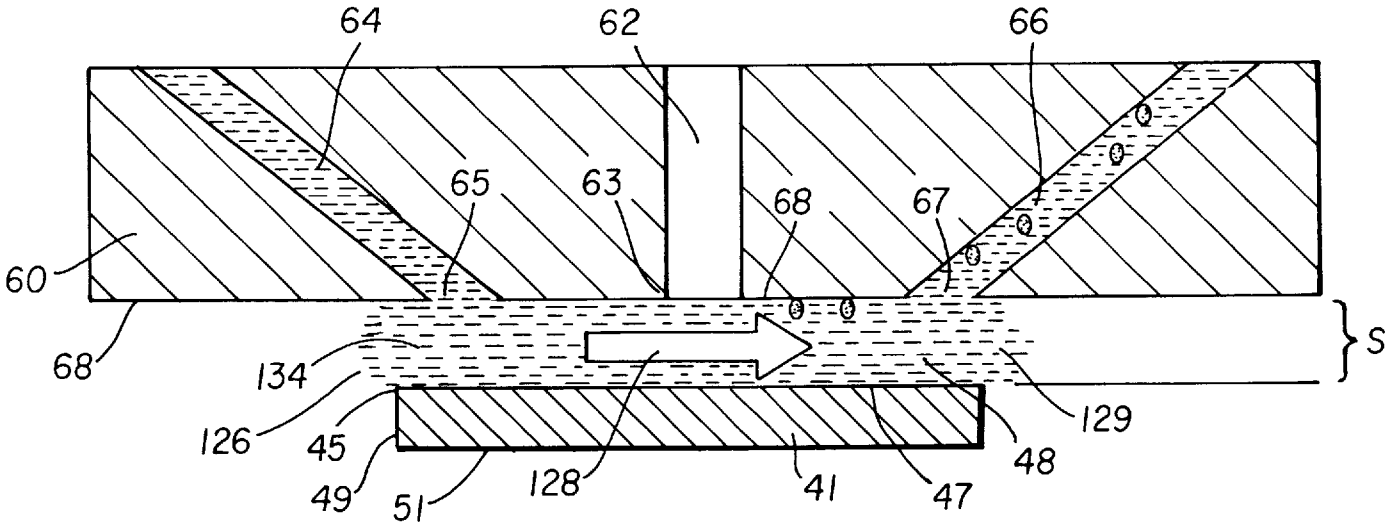
FIG. 3*a* shows an enlarged cross section view of the orifice plate, capillary fluid flow path and the cleaning surface.
Figure 3B:
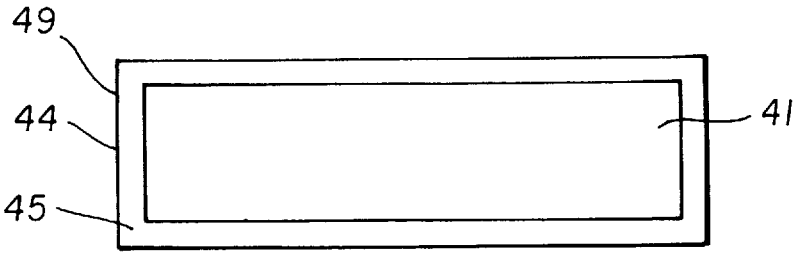
FIG. 3*b* shows a view of the bottom surface of the cleaning surface.

FIG. 3*a* shows an enlarged cross section view of the orifice plate, capillary fluid flow path and the cleaning surface and FIG. 3*b* shows a view of the bottom surface of the cleaning surface. As is shown in FIGS. 3*a* and 3*b*. Cleaning surface 41 comprises a bottom surface 47, a top surface 51 and side walls 49 joining bottom surface 47 to top surface 51. Bottom surface 47 and side walls 49 are joined at an edge 45. A perimeter 44 is defined on bottom surface 47 along edge 45. Typically, perimeter 44, is 1 to 10 microns wide. Although perimeter 44 is shown in FIG. 2 as co-planar with the bottom surface 47, perimeter 44 can be located either above or below bottom surface 47. Perimeter 44 is generally shaped to conform to the shape of outer surface 68 to permit a nearly constant spacing to be defined between bottom surface 47 and outer surface 68 in the region of perimeter 44.

Actuator 29 is used to position cleaning surface 41 proximate to outer surface 68 so that bottom surface 47 confronts outer surface 68 in a region of outer surface 68 that includes at least a cleaning orifice 65 and a drain orifice 67. In a preferred embodiment, bottom surface 47 confronts outer surface 68 in a region that includes cleaning orifice 65, drain orifice 67 and ink jet orifice 63. Actuator 29, however, does not advance bottom surface 47 into contact with outer surface 68. Instead, actuator 29 moves bottom surface 47 to a position that is proximate to and separate from outer surface 68. The space between bottom surface 47 and outer surface 68 defines a capillary fluid flow path 48.

In the present invention, actuator 29 positions perimeter 44 at a position where perimeter 44 is separated by a distance S from outer surface 68. S is preferably established in the range of from 0.1 to 100 microns, to ensure that cleaning fluid 134 is confined to capillary fluid flow path 48, even when the pressure of the cleaning fluid 134 in cleaning fluid flow path 48 is above atmospheric pressure. The separation S can be reliably established in a number of ways. In one embodiment, a highly accurate mechanical positioning structure (not shown) cooperates with actuator 29 to guide outer surface 68 and perimeter 44 to create separation S. Such a structure can be created using manufacturing technologies such as Micro-Machining, as is well known in the art of Micro-Systems Technology (MST).

In an alternate embodiment, one or more sensors (not shown) cooperates with actuator 29 to position perimeter 44 at a distance S from the outer surface 68. In this embodiment, the sensor provides a signal that is indicative of the position of the perimeter 44 relative to outer surface 68 at one or more locations around perimeter 44 and actuator 29 is operated to move the perimeter 44 to a position that is removed from outer surface 68. In this regard, actuator 29 may be formed from microfabricated actuator structures that are well known in the MST art. Actuator 29 can also comprise a piezoelectric actuator.

In one embodiment of the present invention, the capacitance between perimeter 44 and outer surface 68 is sensed and used as a measure of the separation S. In this embodiment, the capacitance between perimeter 44 and outer surface 68 is sensed. Controller 24 determines proximity of perimeter 44 to outer surface 68 as a function of this capacitance. Controller 24 then operates actuator 29 to modify the position of cleaning surface 41 to maintain the separation S between the perimeter 44 and the outer surface 68. In one embodiment, perimeter 44 is made from an electrically conductive material and the capacitance between the electrically conductive material of the perimeter 44 and the outer surface 68 is measured. In another embodiment, one or more capacitance sensors(not shown) are disposed on perimeter 44. These sensors can be defined using microfabricated sensor structures that are well known in the MST art.

It will be understood that the separation S between perimeter 44 and outer surface 68 can also be measured using acoustic delay sensors or optical sensors. These sensors can also be microfabricated using known techniques.

It will be appreciated that other controllers that are well known in the art of control systems can be provided to cause actuator 29 to maintain the separation S in response to signals received from a sensor. Such controllers can work independently from controller 24. Such controllers can also work in co operation with controller 24.

After the perimeter 44 of cleaning surface 41 is positioned at a desired distance S from outer surface 68, a pressurized flow 128 of cleaning fluid 134 is discharged from the cleaning fluid orifice 65 and enters capillary fluid flow path 48. The cleaning fluid 134 may be any suitable liquid solvent composition, such as water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the liquid. In certain embodiments of the present invention, ink can be used as a cleaning fluid. As the pressurized flow 128 of cleaning fluid 134 expands on outer surface 68 it approaches the bottom 47 of cleaning surface 41. At this point capillary attraction causes cleaning fluid 134 to bridge between cleaning surface 41 and outer surface 68. As the flow continues, the volume of cleaning fluid bridge 129 expands between bottom surface 47 and outer surface 68 until it reaches edge 45 of cleaning surface 41.

A meniscus 126 of cleaning fluid 134 forms between outer surface 68 and cleaning surface 41 at edge 45. Meniscus 126 forms a fluidic seal that prevents the pressurized flow 128 of cleaning fluid 134 out of capillary fluid flow path 48. To contain a flow 128 of pressurized cleaning fluid 134 within capillary fluid flow path 48, meniscus 126 must be stable even when the cleaning fluid pressure in the capillary fluid flow path 48 is not at atmospheric pressure. This may occur, for example, when the pressure of the cleaning fluid 134 in the capillary fluid flow path 48 is greater than the atmospheric pressure outside of the capillary fluid flow path 48. This may also occur, for example, when the cleaning fluid 128 pressure in the capillary fluid flow path 49 is less than atmospheric pressure.

In this regard, the maximum fluid pressure that can be maintained in a capillary fluid flow path 48 of the present invention is a function of the separation S between perimeter 44 and outer surface 68. In particular, the maximum pressure that can be maintained around perimeter 44 of capillary fluid flow path 48 is defined as follows:

$$\text{DeltaP} < 2 * \text{Gamma}/S$$

where delta P is the maximum pressure in the cleaning fluid around perimeter 44 with respect to atmospheric pressure and Gamma is the surface tension of the cleaning fluid 134. This relationship is well known in the art of capillary mechanics. It will be appreciated from this that the maximum pressure that can be retained in a particular capillary fluid flow path 48 is inversely proportional to S. Therefore, in accordance with the present invention S is very small, preferably, 0.1 to 100 microns in order to permit the capillary fluid flow path 48 to contain cleaning fluid at relatively high levels of pressure.

If the pressure in the capillary fluid flow path 48 is nearly constant, as occurs when there is little flow of cleaning fluid from the cleaning orifice to the drain orifice, then the maximum pressure in the flow path must be less than Gamma/S, where S is the largest separation between perimeter 44 and outer surface 68. If the pressure exceeds this value and if drain orifice 67 is substantially defined within the capillary fluid flow path 48, then the meniscus 126 will become unstable and allow cleaning fluid 134 to flow outside of the cleaning fluid flow path 48.

For greater stability of the meniscus 126, it is preferable that outer surface 68 be hydrophilic in the portion of outer surface 68 that is incorporated into the capillary fluid flow path 48. The stability of the meniscus 126 can further be increased where outer surface 68 is hydrophobic in regions that are outside of capillary fluid flow path 48.

Cleaning surface 41 can be formed from a variety of materials. However, it is generally desired that the cleaning fluid be attracted to bottom surface 47 of cleaning surface 41 but be repelled by side walls 49 and top surface 51 of cleaning surface 41. Where, for example, an aqueous based cleaning fluid 134, is used, the cleaning surface 41 can be defined using hydrophilic and hydrophobic surfaces that enhance the stability of meniscus 126. In this regard, bottom surface 47 of cleaning surface 41 shown in FIG. 3 is hydrophilic while the side walls 49 and top surface 51 of the cleaning surface 47 are hydrophobic so that the cleaning fluid 134 does not tend to spread onto side walls 49 or top 51. It is also preferable that bottom surface 47 and side walls 49 of the cleaning surface 41 are defined at right angles with a sharp corner having a radius of curvature on the order of 0.1 micrometers in order to "pin" the meniscus 126 in a stable position preventing it from moving away from perimeter 44, as is known in the art of capillary flow.

Once established, meniscus 126 is sufficiently stable to maintain the integrity of the seal even where a negative pressure with respect to atmospheric pressure is defined within capillary fluid flow path 48. This is possible because the meniscus 126, once pinned at the edge 45 of cleaning surface 41, requires a pressure difference in order to be withdrawn from the edge 45 of the cleaning surface. The magnitude of this pressure difference is defined by the pressure equation discussed above. Thus, meniscus 126 is stable and provides an effective seal for capillary fluid flow path 48 over a range of positive and negative fluid pressures. The degree to which this range can deviate from atmospheric pressure is defined, under the equation described above, as a function of the surface tension of the cleaning fluid 134 and S. Importantly, the pressure is inversely proportional to the magnitude of S thus, the pressure in the capillary fluid flow path 48 can be substantially increased over atmospheric pressure or decreased from atmospheric pressure where S is minimized.

Over the range of pressures, the shape of the fluidic seal changes but the line of contact between the meniscus 126 and perimeter 44 does not change. Thereby, the exact shape, size and pressure distributions of the capillary fluid flow path 48 are known and can be precisely controlled by controlling the pressures of the cleaning fluid 124 in the cleaning fluid flow path 136, and drain fluid flow path 156. This can be accomplished, for example, by controlling the pressure in cleaning fluid reservoir 132 and drain reservoir 152, or by controlling the operation of cleaning fluid pump 138 and drain pump 158. This is particularly advantageous when only a single drain orifice 67 is present and is located inside the perimeter 44. In such an embodiment, the meniscus 126 will remain stable despite changes in the pressure distribution within the capillary fluid flow path 48 that are used to balance the rate of flow of cleaning fluid 134 entering capillary fluid flow path 48 and the rate of cleaning fluid 134 leaving capillary fluid flow path 48 via drain fluid flow path 156.

The meniscus 126 is also useful in allowing the print head to be positioned at a range of angles during cleaning. This range of angles includes angles up to 90 degrees relative to the angle of gravitational force acting on the print head. It will be understood that this is possible because the gravitational pressure drop across a one inch long print head that is oriented vertically is only about 1/400 of an atmosphere. In comparison, the pressure tolerance of a meniscus 126 for which S is, for example, 7 microns is 1/10 of an atmosphere for a typical cleaning fluid.

As described above, mechanical force can be used to physically remove contaminant 80 from outer surface 68 and ink jet orifice 63. In the present invention, this mechanical force is provided by a flow 128 of pressurized cleaning fluid 134 within the capillary fluid flow path 48. Flow 128 is created by a pressure gradient, between cleaning orifice 65 and drain orifice 67. In such a pressure gradient, the fluid pressure at cleaning orifice 65 is provided at a level that is greater than the fluid pressure at the drain orifice 67. It will be understood that the pressure gradient is relative and that a pressurized flow 128 of a cleaning fluid 134 can be created even where the fluid pressure of the cleaning fluid 134 at drain orifice 67 is positive. Accordingly it will also be understood that such a pressure gradient can be achieved without applying a vacuum to drain orifice 67.

The cleaning capabilities of the pressurized flow 128 of cleaning fluid 134 can be enhanced through the use of an optional ultrasonic transducer 46 is shown in FIG. 2. This transducer 46 is fixed to cleaning surface 41 and serves to ultrasonically excite the flow 128 of cleaning fluid 134 as it flows through capillary fluid flow path 48. The ultrasonic excitation helps to dislodge contaminant 80 from surface 68 and ink jet orifice 63. In an alternative embodiment, actuator 29 can be operated to oscillate cleaning surface 41 in order to excite the flow 128 of cleaning fluid 134. Actuator 29 can be operated at ultrasonic or other frequencies to excite the flow 128 of cleaning fluid 134.

It will be recognized that, using the capillary fluid flow path 48 of the present invention, it is possible to define, with great precision, the areas of outer surface 68 that will be cleaned. This is because the pressurized flow 128 of cleaning fluid 134 spreads out to fill the entire capillary fluid flow path 48 during cleaning. Thus, cleaning fluid flow path 48 only exists in regions of orifice plate 68 that are within perimeter 44 of cleaning surface 41. Thus, the size, shape and course taken by the capillary fluid flow path 48 is defined by the geometric properties of the perimeter 44 of bottom surface 47. From this, it will be appreciated that it is possible to a capillary fluid flow path having a very complex pattern simply by modifying the shape of the perimeter 44 of bottom surface 47. In this regard, perimeter 44 of bottom surface 47 can be defined to provide a variety of structures to control the flow 128 of cleaning fluid 134 from a cleaning orifice 68 to a drain orifice 67.

The size shape and course taken by the capillary fluid flow path 48 can also be defined by other characteristics of the bottom surface 47. For example, regions of bottom surface 47 and outer surface 68 within perimeter 44 can be defined that have hydrophilic properties and that have hydrophobic properties. These properties can also be used to define and the capillary fluid flow path 48.

It will be appreciated that these features may be combined to provide very accurate control of the flow 128 of cleaning fluid 134 across outer surface 68. A number of specific example embodiments will be discussed in greater detail below.

It will also be appreciated that, although cleaning surface 41 is shown in FIG. 2 as being located in a cleaning area 40, cleaning surface 41 can be positioned at any location along the X-axis of travel of print head 50. As will be shown in greater detail below, the cleaning surface 41 and actuator 29 can move with print head 50 to reduce the overall size of the printer 20 to eliminate the time required to traverse print head 50 to cleaning area 40.

Fluid Flow System

Figure 4:
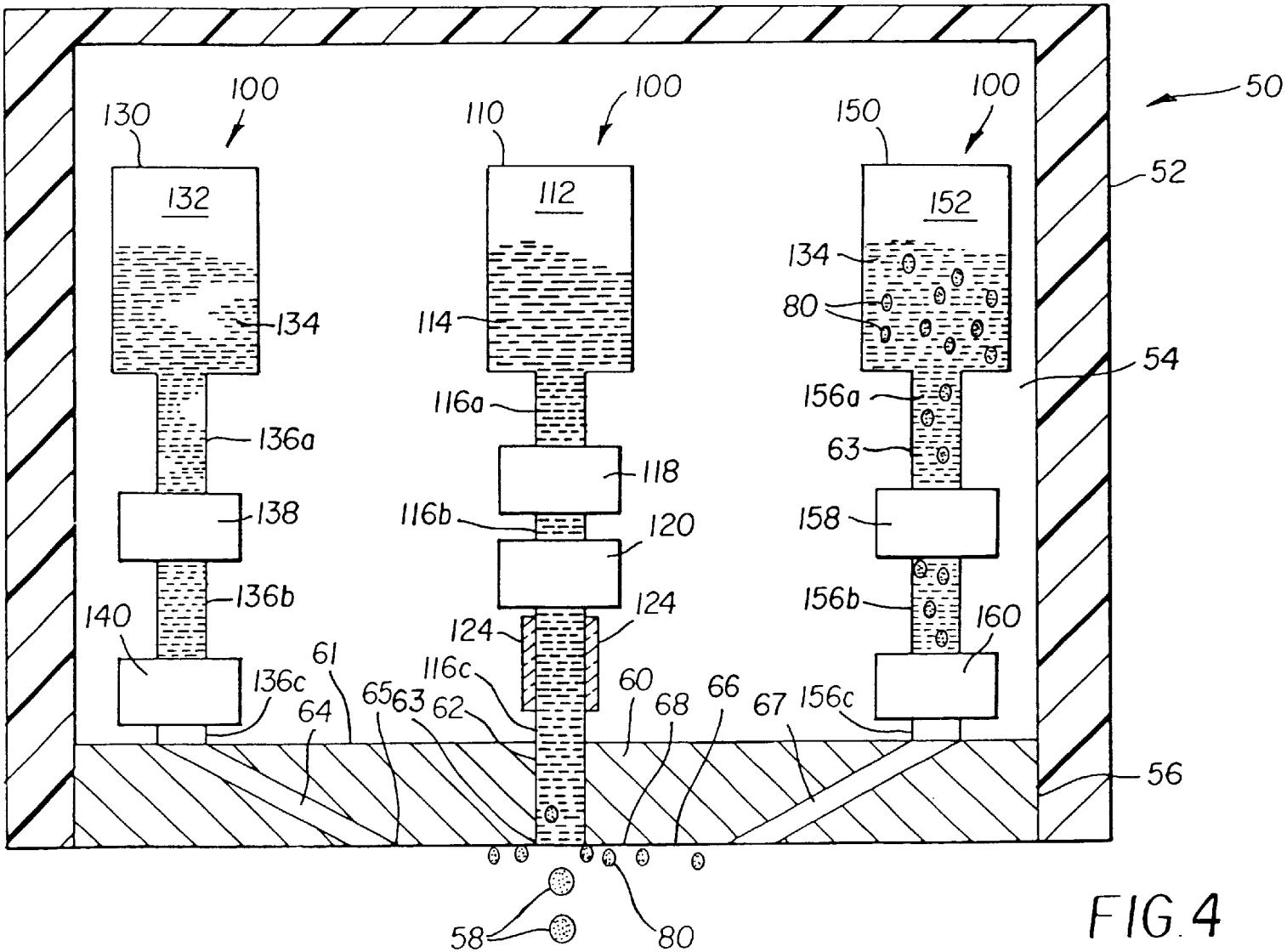
FIG. 4 shows a partial cross-section of the self-cleaning print head of the present invention with the fluid flow system shown in greater detail, and operating in a printing mode.

Turning now to FIG. 4, what is shown is a partial cross-section of self-cleaning print head 50 of the present invention, with one embodiment of fluid flow system 100 shown in greater detail. As is shown in FIG. 4 and described herein, fluid flow system 100 is contained within the print head 50. However, it will be appreciated that elements of the fluid flow system 100 can be provided by structures that are external to the print head 50 and that cleaning fluid 134, and ink 114 can be conveyed to and from print head 50 by means of hoses (not shown) or other like members. Print head 50 comprises a print head body 52, defining a cavity 54 having an open end 56. Print head 50 also comprises an orifice plate 60, as described above, in open end 56.

In the embodiment of FIG. 4, pressurized ink source 110 is contained within the cavity 54 and comprises a reservoir 112 containing ink 114, an ink pump 118, and an ink valve 120. An ink fluid flow path 116*a* connects ink reservoir 112 to the ink pump 118. Ink fluid flow path 116*b* connects ink pump 118 to ink valve 120. Ink fluid flow path 116*c* joins ink valve 120 to ink jet passageway 62. During printing operations, ink 114 is drawn from the reservoir 112 by action of pump 118. Pressurized ink 114 from the pump 118 is then advanced down the ink fluid flow path 116*b* to the ink valve 120. During printing operations the ink valve 120 is maintained in open position allowing ink 114 to pass through the ink valve 120. To print image 32 on media 34, ink droplets 58 are released from ink jet orifice 62 in the direction of media 28, so that droplets 58 are intercepted by media 34.

To generate the ink droplets 58, at least one segment of the ink fluid flow path 116, for example 116*c*, is formed of a piezoelectric material, such as lead zirconium titanate (PZT). Such a piezoelectric material is mechanically responsive to electrical stimuli so that side walls 124 simultaneously inwardly deform when electrically stimulated. When side walls 124 simultaneously inwardly deform, volume of ink fluid flow path 116*c* decreases to squeeze ink droplets 58 from ink jet orifice 63. Ink droplets 58 are preferably ejected along an axis normal to orifice 63.

Pressurized supply of cleaning fluid, 130 comprises a cleaning fluid reservoir 132 containing a supply of cleaning fluid 134, a cleaning fluid pump 138 and a cleaning fluid valve 140. Cleaning fluid reservoir 132 and the cleaning fluid pump 138 are joined by cleaning fluid flow path 136*a*. Cleaning fluid pump 138 and cleaning fluid valve 140 are joined by cleaning fluid flow path 136*b*. Cleaning fluid valve 140 is, in turn, joined to cleaning fluid passageway 64 by cleaning fluid flow path 136*c*.

Fluid return 150 comprises drain reservoir 152 containing a cleaning fluid 132 and contaminant 80, a drain fluid pump 158 and a cleaning fluid valve 160. Drain fluid reservoir 152 and drain fluid pump 158 are joined by drain fluid flow path 156*a*. Drain fluid pump 158 and the drain fluid valve 160 are joined by drain fluid flow path 156*b*. Drain fluid valve 160 is, in turn, joined to drain fluid passageway 66 by drain fluid flow path 156*c*. During printing operations, cleaning fluid valve 140 and drain fluid valve 160 are closed.

Figure 5:
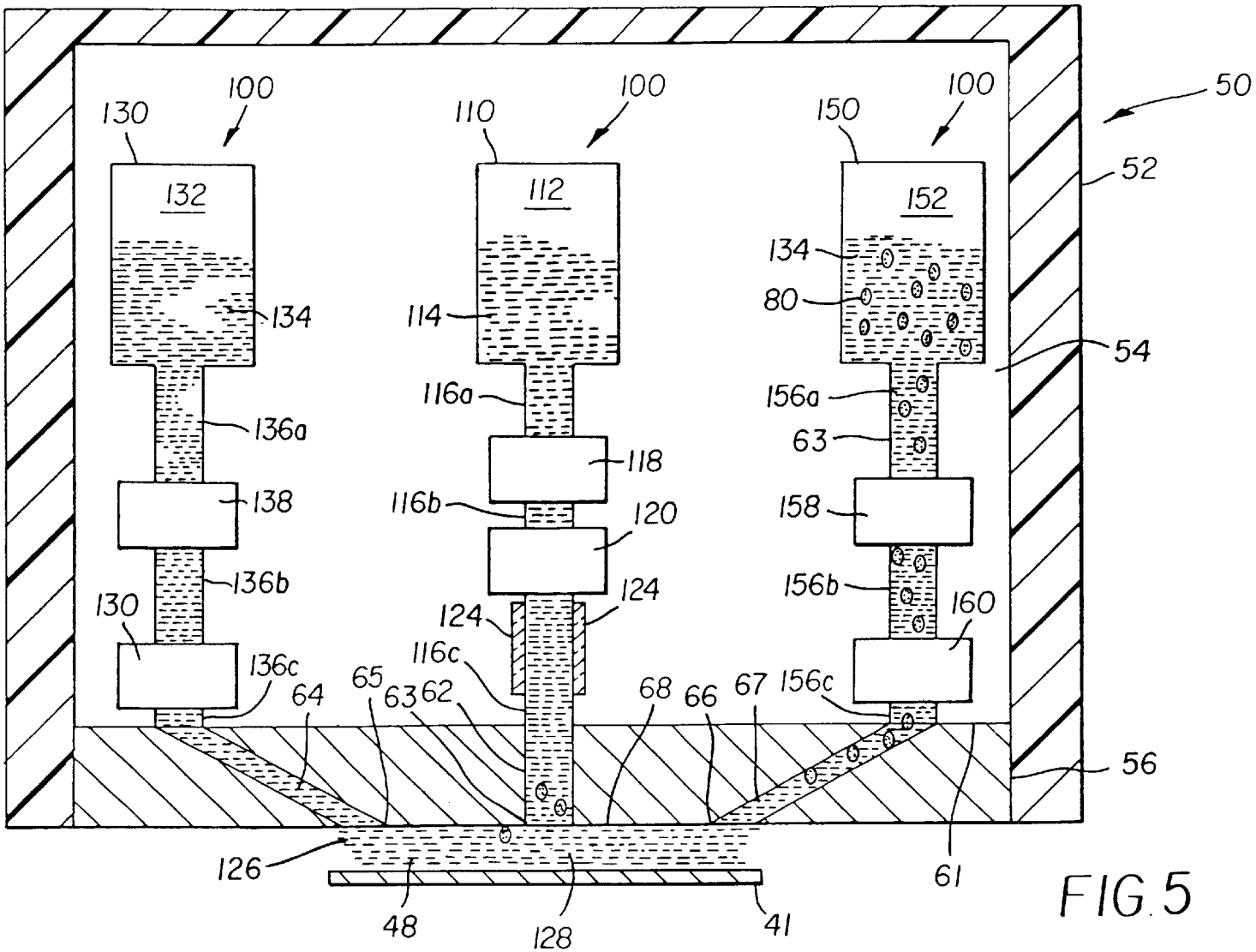
FIG. 5 shows a partial cross-sectional view of an embodiment of the print head of the present invention with the fluid flow system shown in greater detail operated in a cleaning mode with the cleaning surface separated from the outer surface of the print head.

FIG. 5 shows print head 50 of the present invention in partial cross section during a self-cleaning operation. During cleaning operations, cleaning surface 41 is advanced by actuator 29 to a position that is proximate to but separate from outer surface 68. This defines capillary fluid flow path 48 that extends over a portion of the outer surface 68 including cleaning orifice 65, ink jet orifice 63 and drain orifice 67.

When the cleaning surface 41 is so positioned, pump 138 is activated. This draws cleaning fluid 134 from the cleaning fluid reservoir 132. Pump 138 pressurizes cleaning fluid 134 to create pressurized flow 128 of cleaning fluid 134 in fluid flow path 136*b*. Valve 140 is opened permitting the pressurized flow of cleaning fluid into cleaning fluid flow path 136*c* and into cleaning fluid passageway 64. This flow 128 of cleaning fluid 134 is discharged from cleaning orifice 65 into the capillary fluid flow path 48. Flow 128 of cleaning fluid 134 enters capillary fluid flow path 48. The cleaning fluid pressure at drain orifice 67 is held at a level that is lower than the fluid pressure at the cleaning orifice 65. This causes a flow of cleaning fluid from the cleaning orifice 65, through the capillary fluid flow path 48 and into the drain orifice 67.

In the embodiment shown in FIG. 5, pump 158 reduces the pressure at drain orifice 67 to a pressure level that is lower than the pressure at the cleaning fluid orifice. Pump 158 removes the cleaning fluid 134, ink 114, and contaminant 80 from the drain orifice 67 into reservoir 152 by way of drain fluid flow path 156*a*. It will be appreciated that in an alternative embodiment, the pump defines According to the embodiment of the present invention shown in FIG. 5, the flow 128 of cleaning fluid 132 through the capillary fluid flow path 48 is defined so as to cause a flow 128 of cleaning fluid 132 to enter ink jet passageway 62 in order to remove any ink 114 or contaminant 80 from ink jet passageway 62, ink jet orifice 63, or the ink fluid flow path 116(*b*) or 116(*c*). In this regard, the pressure at the ink jet orifice 63 pressure can be lowered to draw cleaning fluid 134 into the ink jet orifice 63. This can be done by action of the piezoelectric sidewalls 124 of ink fluid flow path 116*b*, or by an optional second cleaning fluid pump (not shown) connected to the ink fluid flow path 116(*b*), or 116(*c*).

This can also be accomplished by defining the pressure in the capillary fluid flow path 48 so that cleaning fluid 134 enters and exists ink jet orifice 63 to remove contaminant 80. In such an embodiment, the pressure at the ink jet orifice 63 is defined at a level that is lower than the pressure differential between the cleaning orifice 65 and the drain orifice 67. This causes a flow 128 of cleaning fluid 134 into the ink jet orifice 63. By modulation of the magnitude of the pressure differential between cleaning orifice 65 and drain orifice 67 the cleaning fluid 134 can be moved into and out of ink jet orifice 63 during cleaning. However, in such an embodiment, the separation S must be defined as being less than or equal to 12 the diameter of ink jet orifice 63 and the suction force at drain orifice 67 must not be greater than 2*Gamma/S.

In FIG. 5, ink jet valve 120 is shown closed, blocking the flow of ink 114 during the cleaning process. However, it will be understood that a flow of ink 114 can be defined concurrently with the flow 128 of cleaning fluid 134 to facilitate cleaning of the ink jet orifice 63 and ink jet passageway 62. In this manner, it is not necessary to cause cleaning fluid to flow into the ink jet orifice 63.

Figure 6:
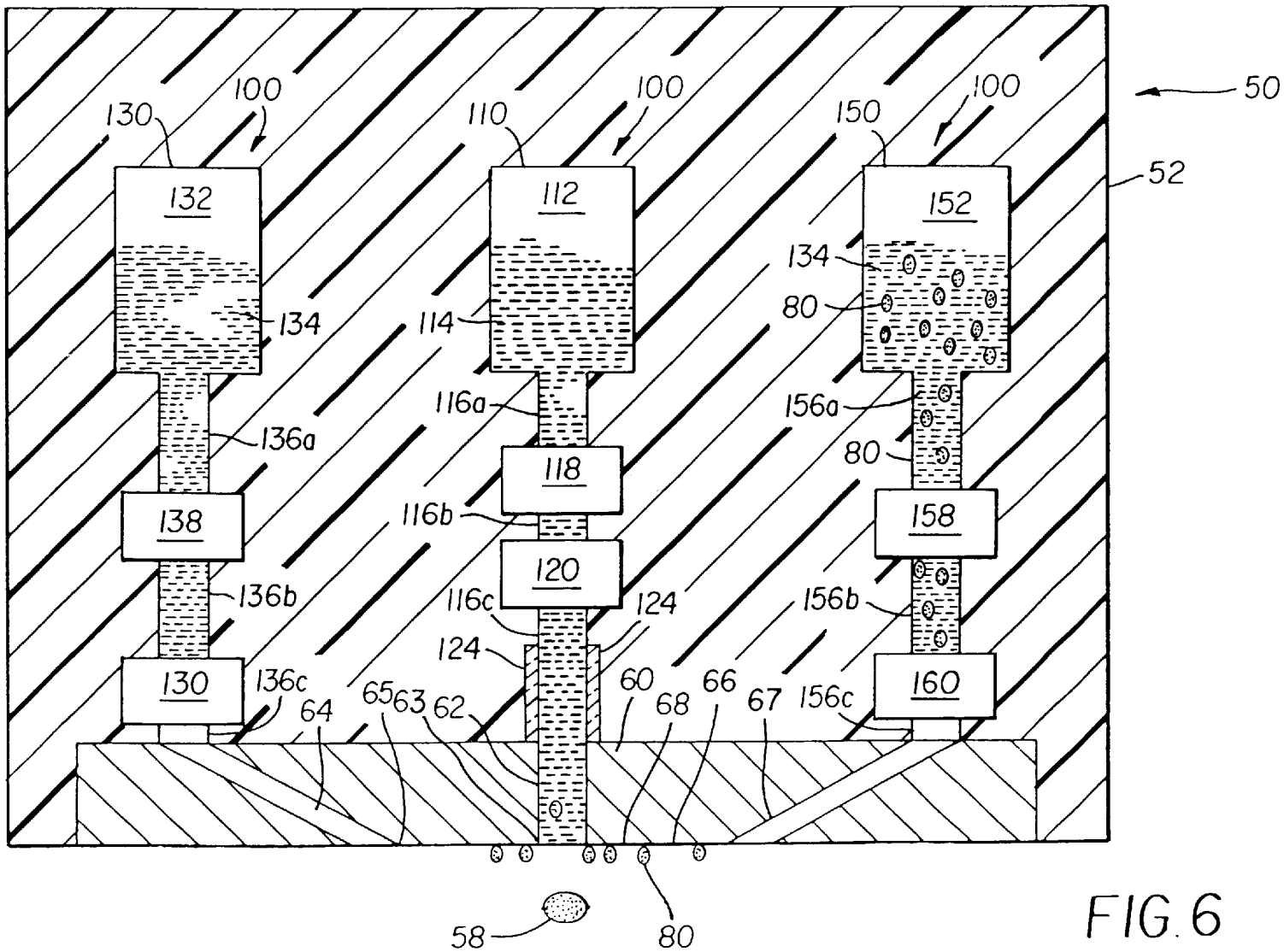
FIG. 6 shows an embodiment of the present invention wherein the print head body comprises a single structure defining the orifice plate, the ink jet orifice, the cleaning orifice, the drain orifice, and the fluid flow path.

FIG. 6 shows the print head 50 of the present invention wherein the print body 54 comprises a single structure defining the orifice plate 60, fluid flow guides 70 and portions of the fluid flow system 100 including, but not limited to, ink fluid reservoir 112; ink fluid flow path 116*a*, 116*b* and 116*c*; cleaning fluid reservoir 132; cleaning fluid flow path 136; and cleaning fluid flow path 136*a*, 136*b* and 136*c*; drain fluid reservoir 152, drain fluid flow path 156*a*, 156*b*, and 156*c*, and passageways 62, 64, 66 and orifices 63, 65, and 67.

It will be understood that in the embodiments of FIGS. 3, 4 and 5, the cleaning fluid reservoir 132 and ink reservoir 172 can be pressurized eliminating the need for an ink jet pump 118 and cleaning fluid pump 138.

In certain embodiments, valves 120, 130, 160, and pumps 138, 118, and 158, can also be integrally formed as part of print head body 52. Print head body 52 can be formed, at least in part, from piezoelectric materials to define ink or fluid ejection pumps 118, 138 and 158, valves 120, 130 and 160. An orifice plate 60, as described above, can be integrally formed from print head body 52, or alternatively, print head body 52 can define an area 57 to engage orifice plate 60. Fluidic connections are defined between the source of pressurized ink 110 and the ink jet orifice 63, between the source of pressurized cleaning fluid 130 and the cleaning orifice, and between the fluid return 150 and the drain orifice 67.

In the embodiment shown in FIG. 6, the source of pressurized ink 110, the source of pressurized cleaning fluid 130 and the fluid return 150, are shown as having the same structural elements as are shown in FIG. 4. However, it will be understood that other structures can be used and can be integrally formed in the print head body 52.

Figure 7:
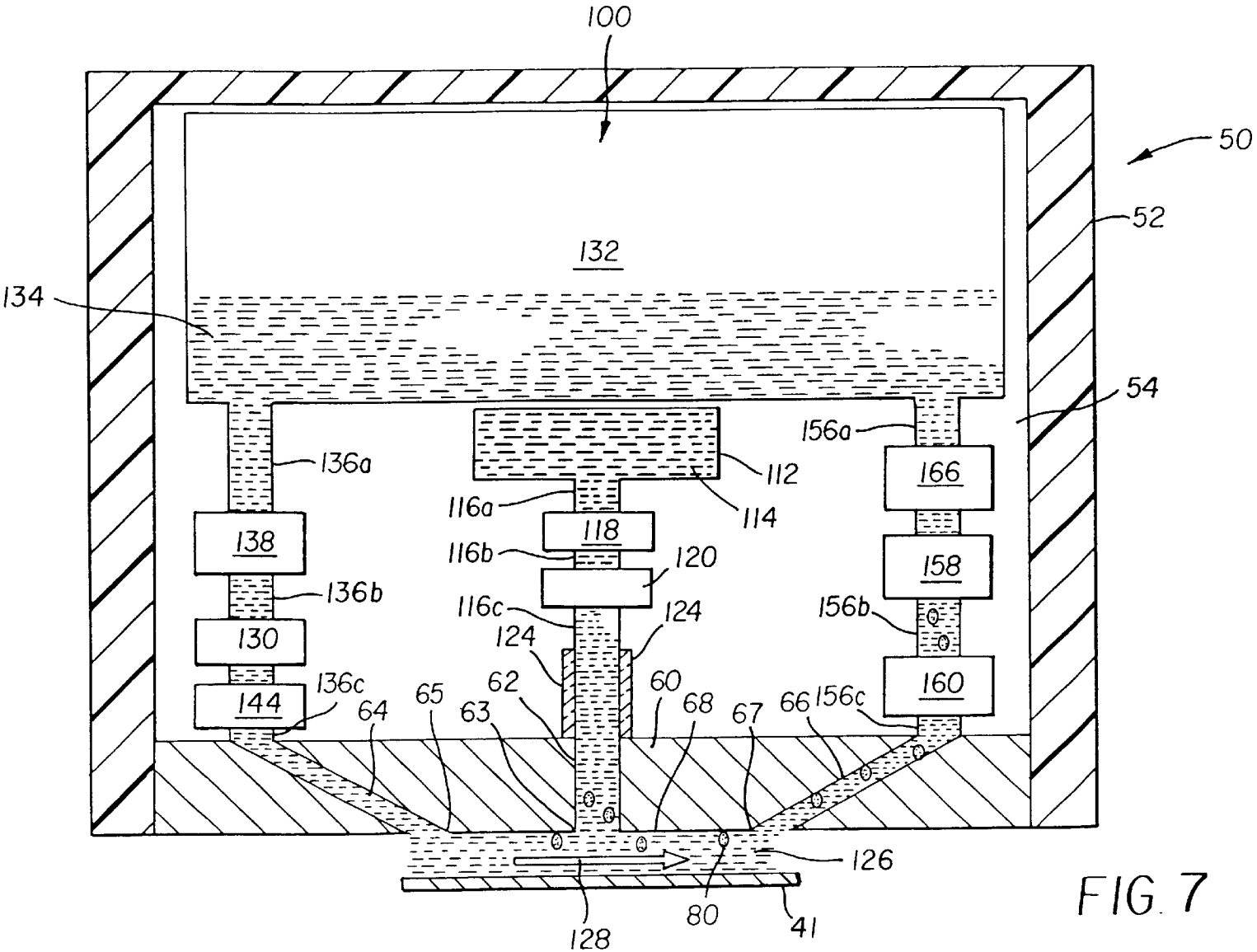
FIG. 7 shows an embodiment of the print head of the present invention having a common cleaning fluid reservoir connected to the cleaning fluid flow path and the drain flow path.

Referring now to FIG. 7, there is shown, in partial cross-section, an alternative embodiment of the print head 50 of the present invention wherein the fluid flow system 100 filters and re-circulates cleaning fluid 134. In this embodiment a single cleaning fluid reservoir 132 is provided. Reservoir 132 is connected to a cleaning fluid flow path 136*a* that is joined to cleaning fluid pump 138. Cleaning fluid pump 138 is joined to cleaning fluid valve 140 by cleaning fluid flow path 136*b*. Cleaning fluid valve 140 is, in turn, joined to cleaning fluid passageway 64 by cleaning fluid flow path 136*c*. During cleaning operations, a flow 128 of cleaning fluid 134 is generated from the cleaning orifice 65 in the manner generally described above.

In the embodiment shown in FIG. 7, the flow 128 of cleaning fluid 134 passes across outer surface 68 and orifice 62, cleans outer surface 68 and ink jet orifice 62 of contaminant 80 and enters drain orifice 67. In the embodiment shown in FIG. 6, cleaning fluid 132 and contaminant 80 are pumped from drain orifice 67, and forced through a filter 166 which passes the cleaning fluid 134 into the cleaning fluid reservoir 132 while trapping contaminant 80. Also shown in FIG. 6, an ultrasonic transducer 144 is connected to cleaning fluid flow path 136*c*. Ultrasonic transducer 144 excites flow 128 of cleaning fluid 134 to enhance the cleaning capabilities of the flow 128 of cleaning fluid 134.

Figure 8:
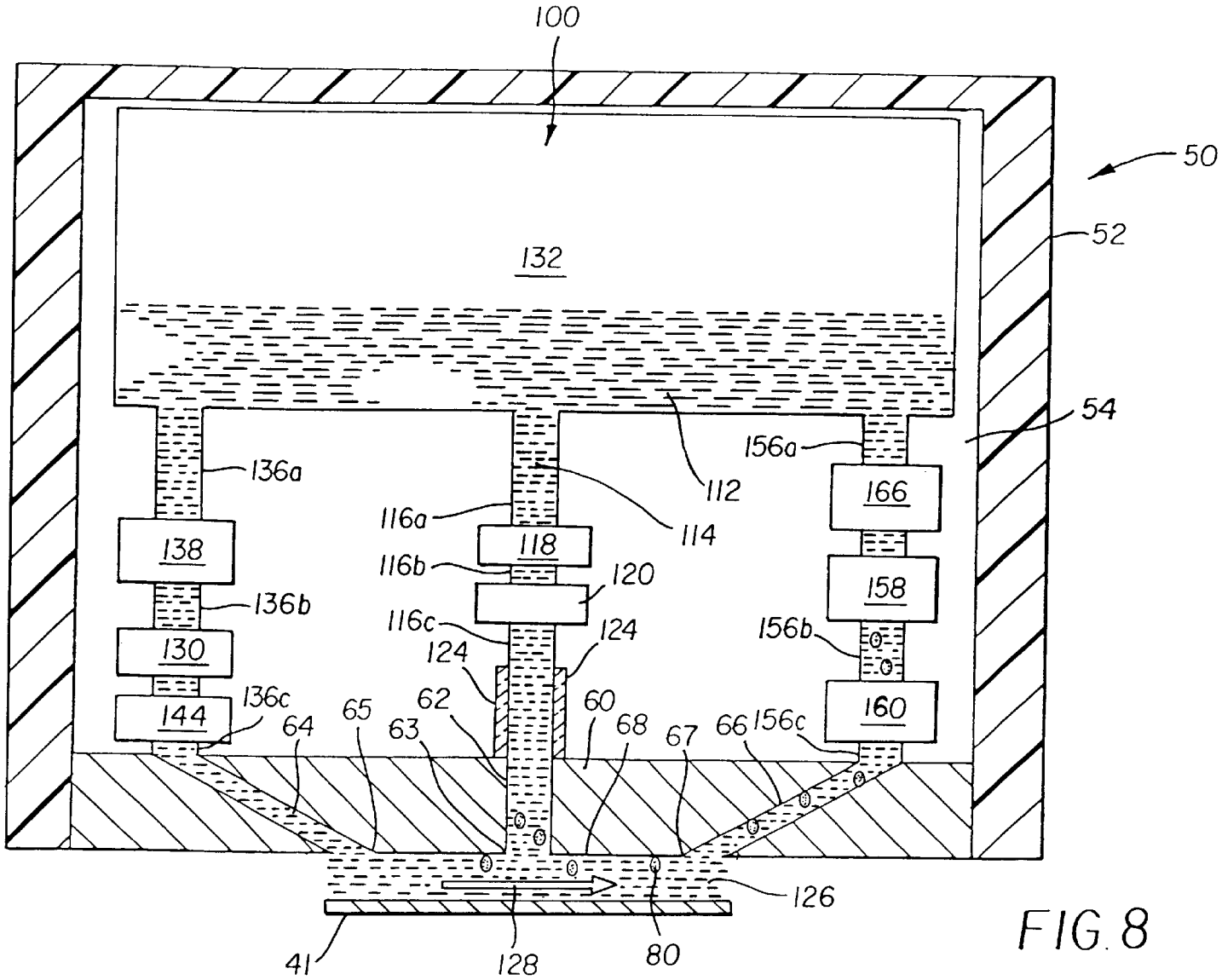
FIG. 8 shows an embodiment of the print head of the present invention having a common cleaning fluid reservoir wherein ink is used as a cleaning fluid.

As is shown in FIG. 8, ink 114 may be used as a cleaning fluid. In this embodiment a single ink reservoir 112, supplies fluid both to the ink pump 118 and the cleaning fluid pump 138. Thus ink 114 is used both for cleaning and printing. In the embodiment shown in FIG. 8, ink 114 that has been used for cleaning is filtered by filter 166 and re-circulated into ink reservoir 112. In another embodiment (not shown) where ink 114 is used as a cleaning fluid 134, the ink jet orifice 63 can be used to discharge a flow 128 of cleaning fluid 134 into the capillary fluid flow path 48. In such an embodiment, cleaning fluid flow path 136, cleaning fluid pump 138, cleaning fluid valve 140 and cleaning fluid orifice 65 are optional. It will also be understood that, generally, with respect to any embodiment herein, ink 112 can be sued as a cleaning fluid 134.

Cleaning Fluid Flow Control Features

In practice, the arrangement of the cleaning orifice 65, the drain orifice 67, the cleaning surface 41 and the ink jet orifice 63 may be as complex or simple as necessary to define a capillary fluid flow path 48 that extends from cleaning fluid orifice 65 across ink jet orifice 63, across outer surface 68 to effectively remove ink 114, and contaminant 80, from outer surface 68 and ink jet orifice 63. Many potential geometric arrangements are possible and the actual arrangement selected for use in an embodiment of the present invention is dependent upon the physical characteristics of the cleaning fluid 134, surface 68, and contaminant 80, the rheology of the ink 114 and the cleaning fluid 134, the number of ink jet orifices 63, cleaning orifices, 65 and drain orifices 67 and the relative orientation of the orifices 63, 65, and 67.

FIGS. 9–18 each depict possible embodiments of the present invention. These figures are offered to help demonstrate just a few of the many possible combinations of elements consistent with the present invention.

Figure 9A:
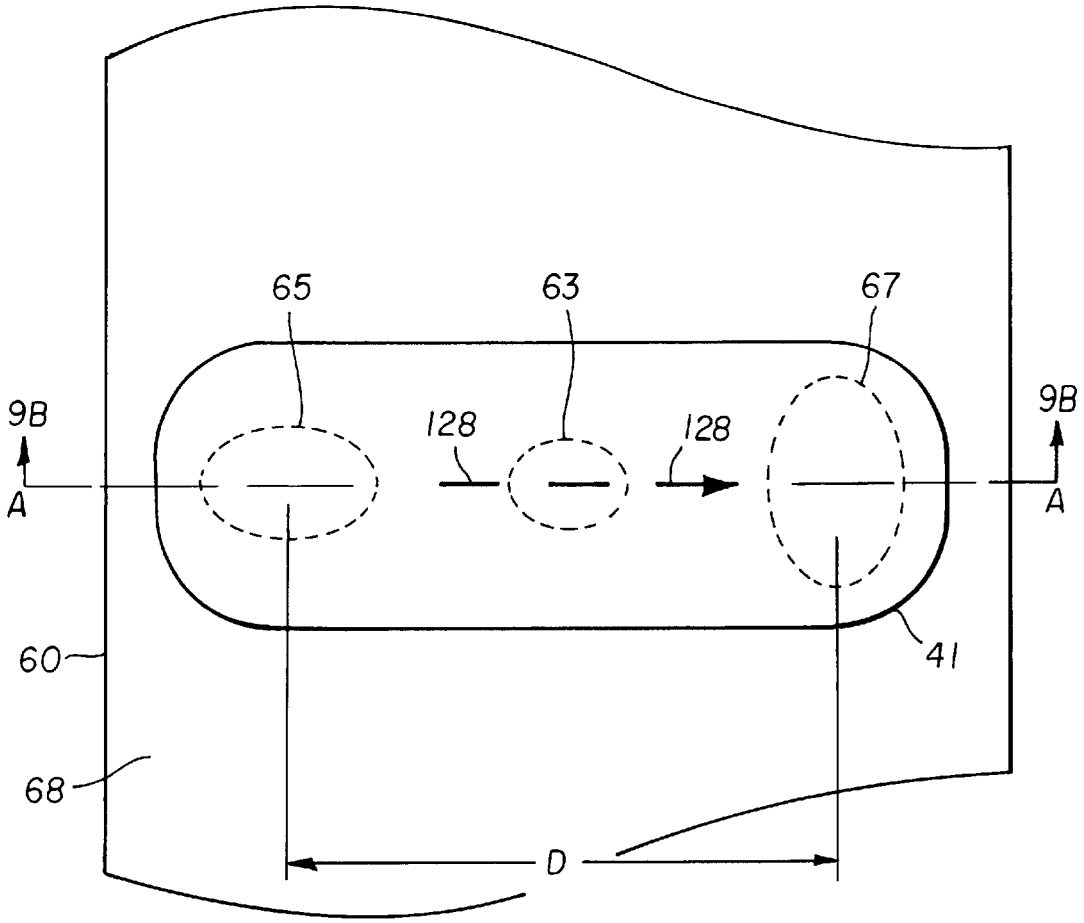
FIG. 9*a* shows the outer surface of the print head and cleaning surface of the present invention in a cleaning position.

FIG. 9*a* shows a view of outer surface 68 of an orifice plate 60 and cleaning surface 41.

In FIG. 9*a,* cleaning orifice 65, ink jet orifice 63, and drain orifice 67, are shown as hidden lines and are arrayed on a single axis A—A. Cleaning surface 41 is positioned relative to outer surface 68 to define a capillary fluid flow path 48 between cleaning orifice 65 and drain orifice 67. This capillary fluid flow path 48 passes over ink jet orifice 63 and portions of outer surface 68 that require cleaning.

The separation between the cleaning and drain fluid orifices, shown as D, in FIG. 9*a* will vary with printing conditions, media selection, the size and relative disposition of the ink jet orifices 63 on the outer surface 68 and the rheology of the ink 114 and cleaning fluid 134 used to clean print head 50. For example, to implement the present invention to clean ink jet orifices 63 and associated surfaces on a 300 dpi (dots per inch) print head, the separation, D, can be defined at any distance within a range between 50 micrometers and 10,000 micrometers. However, the preferred range of separation is between 200 micrometers and 1000 micrometers.

Figure 9B:
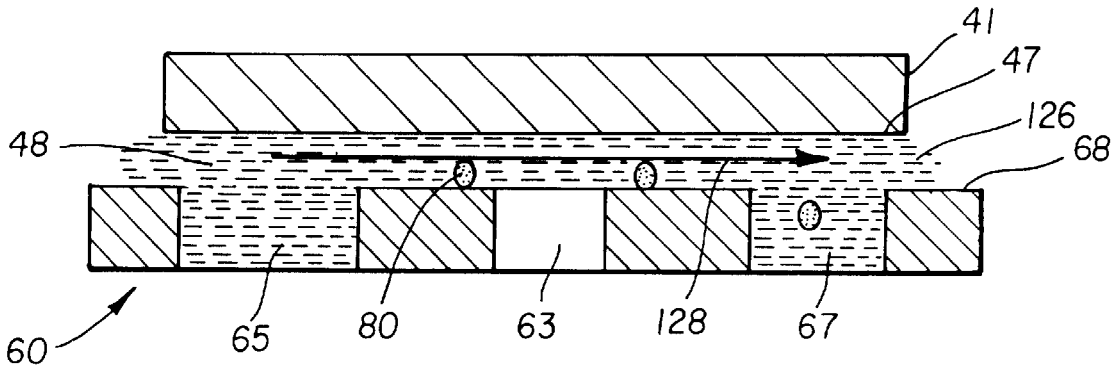
FIG. 9*b* shows a cross-sectional view of the print head and cleaning surface of the present invention.

FIG. 9*b* shows a cross-section of orifice plate 60, cleaning surface 45 and capillary fluid flow path 48 taken along axis A—A. As will is seen in this drawing, a flow 128 of cleaning fluid 134 is defined through the capillary fluid flow path 48 and moves contaminant 80 from surface 68 and into drain orifice 67.

Figure 10A:
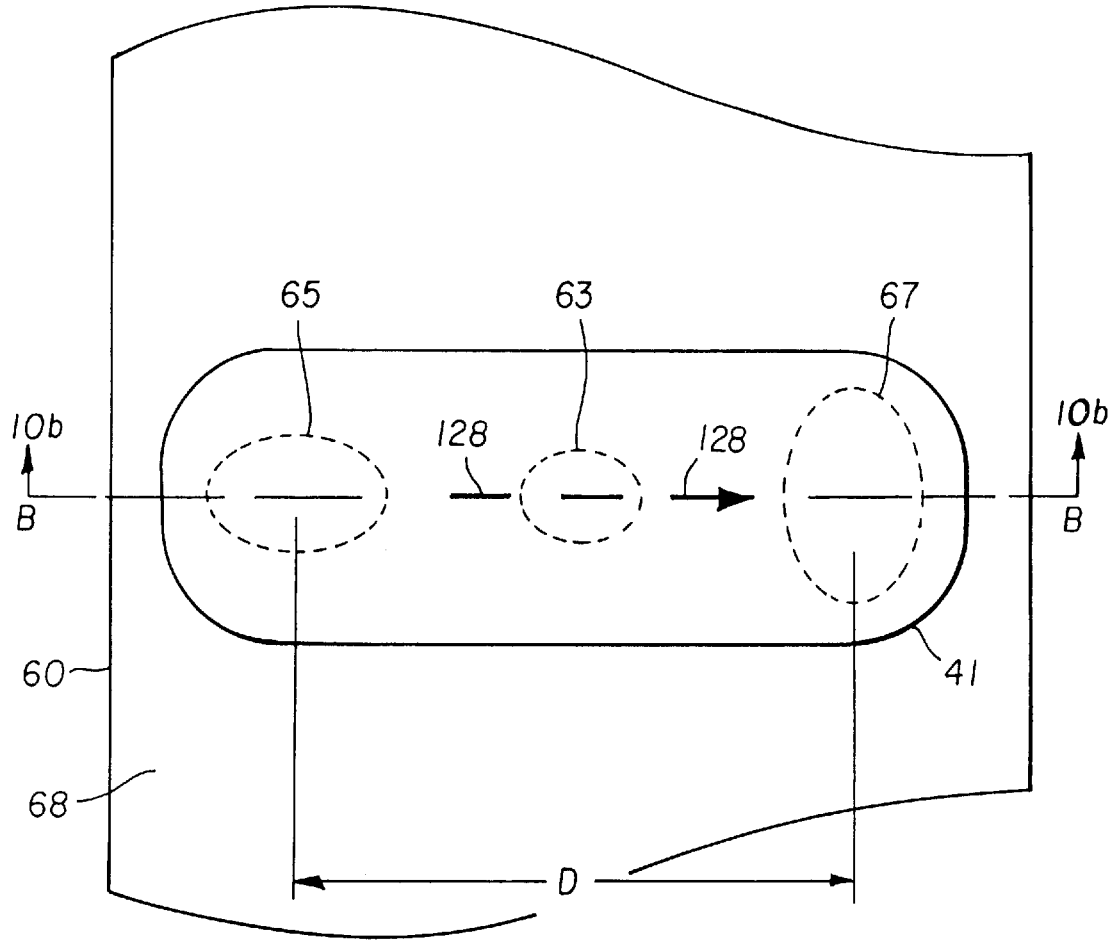
FIG. 10*a* shows the outer surface of the print head and another embodiment of the cleaning surface of the present invention in a cleaning position.
Figure 10B:
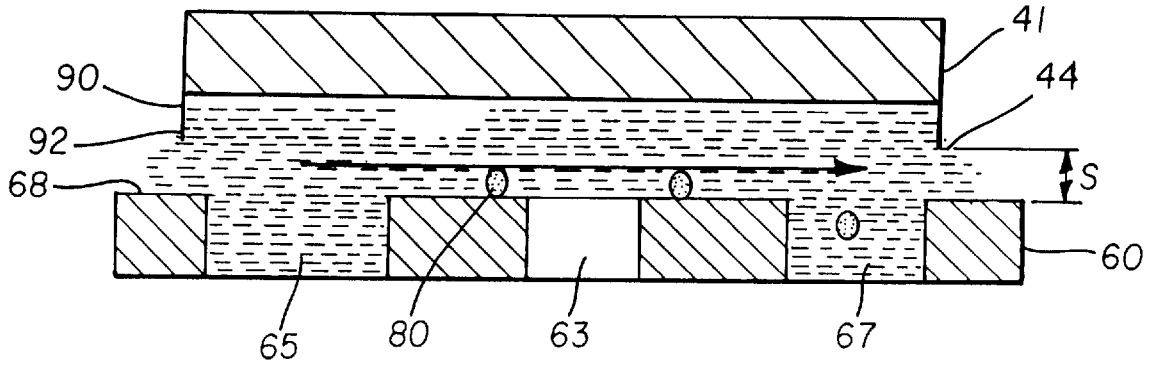
FIG. 10*b* shows a cross-sectional view of the print head, capillary fluid flow path and cleaning surface of the present invention.

FIGS. 10*a* and 10*b,* show another embodiment of cleaning surface 41. In this embodiment, cleaning surface 41 comprises a curtain 90 of a hydrophobic thin film material. As is shown in FIG. 10*b* which depicts a cross-section view taken along axis B—B of orifice plate 60, capillary fluid flow path 48 and cleaning surface 41, curtain 90 depends from edge 45 and extends away from bottom surface 47. Curtain 90 shown in FIG. 9*b* is a polyimide of thickness 1 to 10 microns. It will be recognized that curtain 90 can be formed from other polymer or metallic films. In this embodiment, the pressure that can be contained within cleaning fluid flow path 48 is defined by the separation S between the perimeter 44 and outer surface 68. However, perimeter 44 and edge 45 are defined at the bottom edge 92 of curtain 90. A preferred range of separation between perimeter 44, which is defined at bottom edge 92, and outer surface 68 is in the range of 0.1 to 100 microns.

Figure 11A:
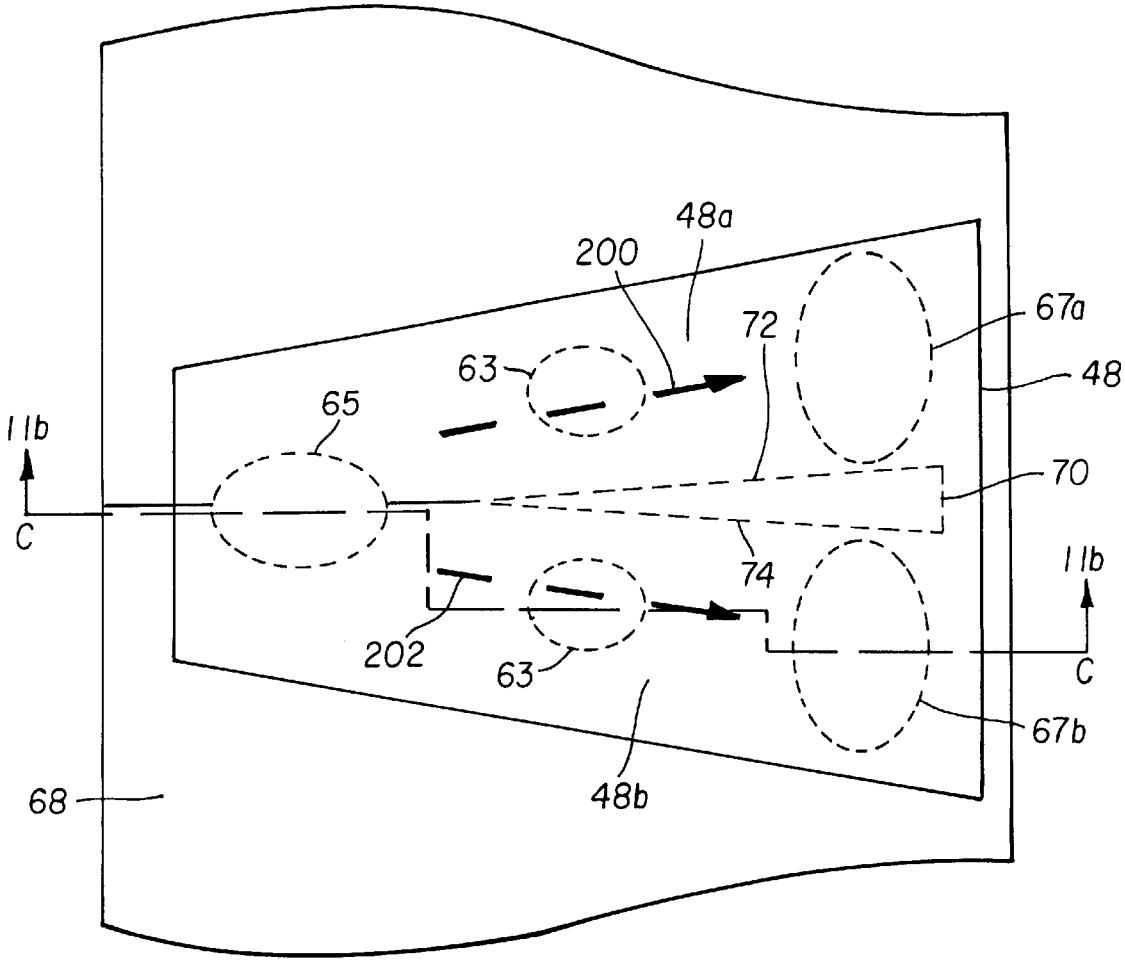
FIG. 11*a* shows the outer surface of the print head and another embodiment of the cleaning surface of the present invention in a cleaning position.
Figure 11B:
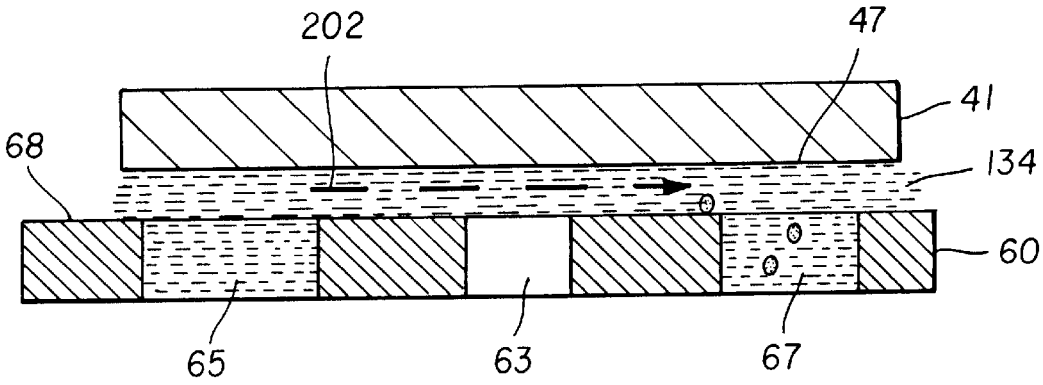
FIG. 11*b* shows a cross-sectional view of the print head, capillary fluid flow path and cleaning surface of the present invention.

FIG. 11*a* shows a partial view of outer surface 68 of an orifice plate 60 depicting another embodiment of the present invention. In FIG. 10*a,* cleaning orifice 65, ink jet orifice 63, and drain orifice 67, are shown as hidden lines. FIG. 10*b* shows a cross section view taken along axis C—C of orifice plate 60, capillary fluid flow path 48 and cleaning surface 41. In this embodiment, a single cleaning orifice 65, defines a single flow 128 of cleaning fluid 134 into the capillary fluid flow path 48. A partition 70 is defined on bottom surface 47. The flow 128 of cleaning fluid 134 cannot penetrate into the areas defined by partition 70. Thus, two capillary fluid flow paths 48*a* and 48*b* are created between bottom surface 47 and outer surface 68. Capillary fluid flow path 48*a* is defined between perimeter 44 and one side 71 of partition 70 and capillary fluid flow path 48*b* is defined between perimeter 44 and the other side 72 partition 70.

Capillary fluid flow path 48*a* guides flow 200 to clean ink jet orifice 63 and surface 68*a* and to flow into drain orifice 67*a,* while capillary fluid flow path 48*b* guides flow 202 to clean ink jet orifice 63 and surface 68*a* and to flow into drain orifice 67*b.*

Partition 70 may be formed in a number of ways. Partition 70 can be formed by a coating of hydrophobic material deposited on bottom surface 47 or it can be formed by a separation, hole, or recess in the bottom surface 68*a.* The partition can also be defined using a hydrophobic coating, or a separation, or hole or recess, defined on outer surface 68. It will of course be understood that other geometric arrangements for partition 70 can be used and that multiple partitions can be defined on outer surface 60 and bottom surface 47. These features can be recombined in any number of patterns to define capillary fluid flow paths 48 to clean any number of ink jet orifices 63 using any number of cleaning orifices 65 and any number drain orifices 67.

Figure 12A:
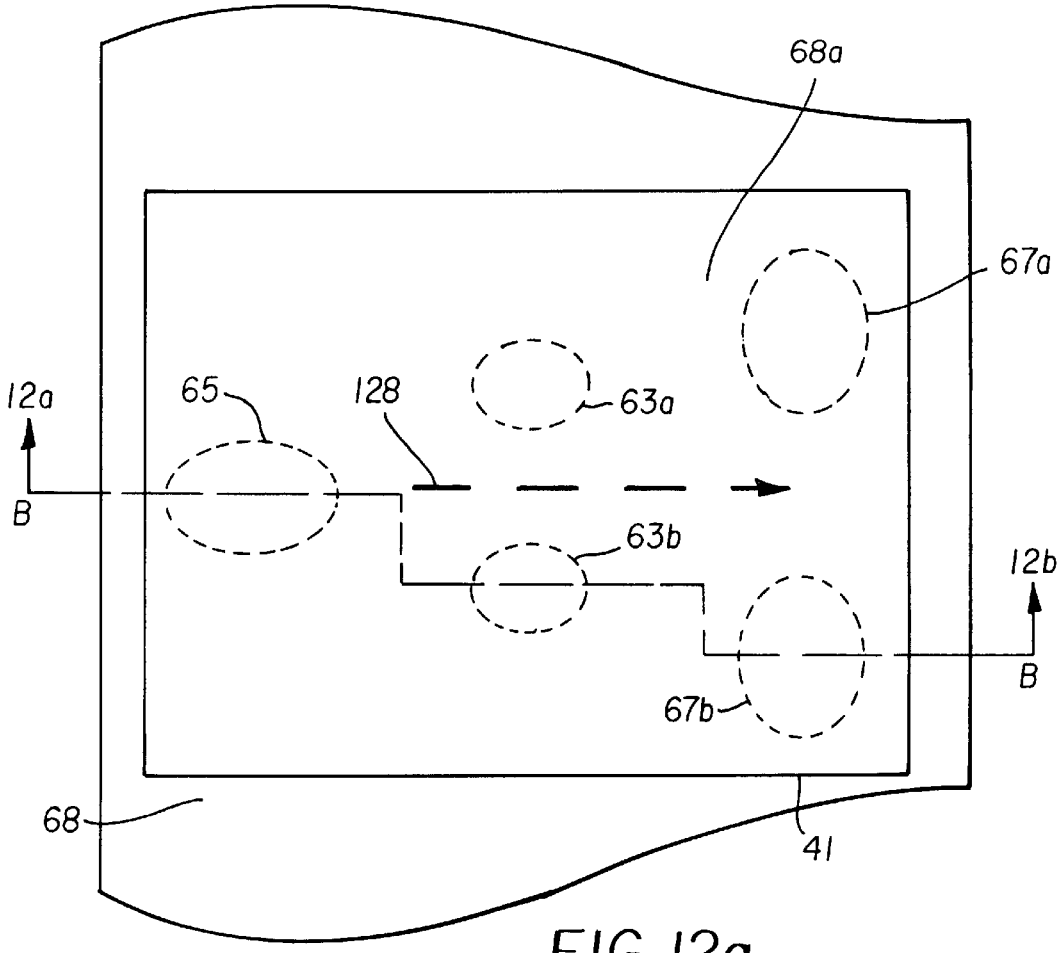
FIG. 12*a* shows the outer surface of the print head and another embodiment of the cleaning surface of the present invention in a cleaning position.
Figure 12B:
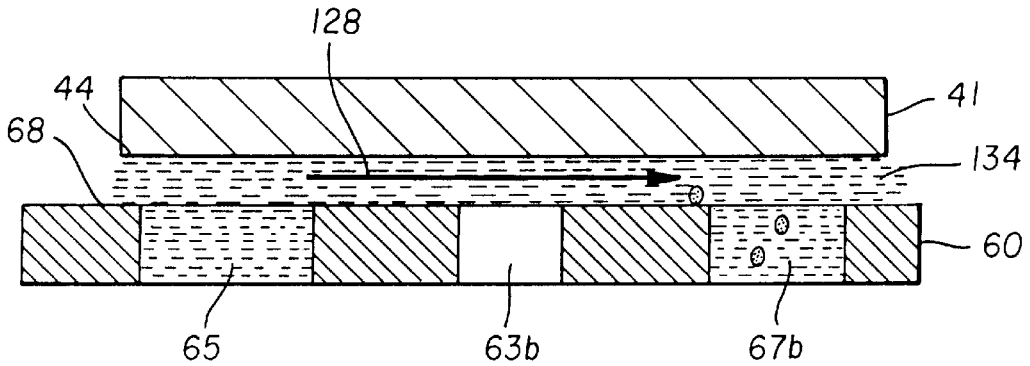
FIG. 12*b* shows a cross-section view of the print head, capillary fluid flow path and cleaning surface of the present invention.

FIG. 12*a* shows a view of outer surface 68 and cleaning surface 41 depicting another embodiment of the present invention. In FIG. 11*a,* cleaning orifice 65, ink jet orifices 63*a* and 63*b,* and drain orifices 67*a* and 67*b,* are shown as hidden lines. As is shown in FIG. 12*a,* it is not necessary to use any partition or like structure to define a flow 128 of cleaning fluid 134 to clean outer surface 68 and ink jet orifice 63. Instead, it will be appreciated that when a flow 128 of a cleaning fluid 134 is defined into a capillary fluid flow path 128 the fluid first expands to fill the flow path and to form the meniscus 128. After this is done, continued flow of cleaning fluid 134 into the capillary fluid flow path 48 generates pressure within the capillary fluid flow path 48. As is shown in FIG. 12*b* which depicts a cross-section of orifice plate 60, cleaning surface 41 and capillary fluid flow path 48, when the pressure in the capillary fluid flow path 48 exceeds the pressure in drain orifice 67, a flow 128 of cleaning fluid 134 begins to flow from cleaning orifice 65, flows across outer surface 68, across ink jet orifices 63*a* and 63*b* and into drain orifices 67*a* and 67*b.* This cleans the entire surface area of outer surface 68 within cleaning fluid flow path 48.

The cleaning surface 41 can define a cleaning fluid flow path 48 that is oversized with respect to the distance D. In such an embodiment, the need to accurately align the cleaning surface 41 with the cleaning orifice 65, drain orifice 68 and ink jet orifice 68 is greatly reduced. It will be appreciated that it is even possible to practice the present invention using a cleaning surface that comprises a simple plate that is positioned at a distance S with respect to outer surface 68 and that is equal to or greater than the size of the outer surface. In such an embodiment, the discharge of cleaning fluid 134 into the capillary fluid flow path 48 will cause the cleaning fluid 134 to form a cleaning fluid bridge 127 that is co-extensive with the outer surface 68 to clean the entire outer surface 68.

Figure 13A:
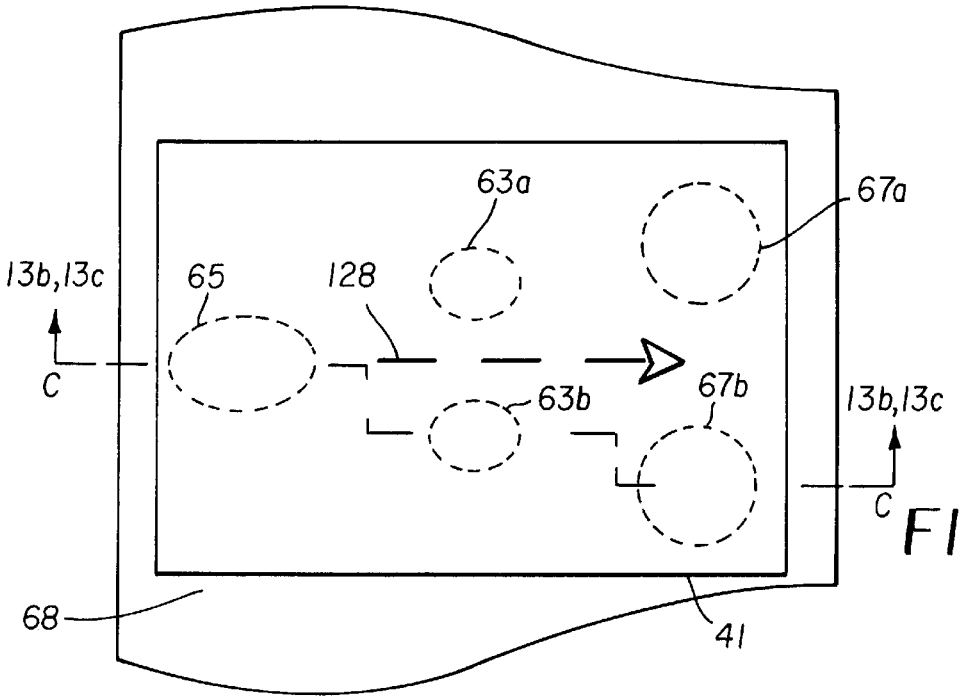
FIG. 13*a* shows the outer surface of the print head and another embodiment of the cleaning surface of the present invention in a cleaning position.
Figure 13B:
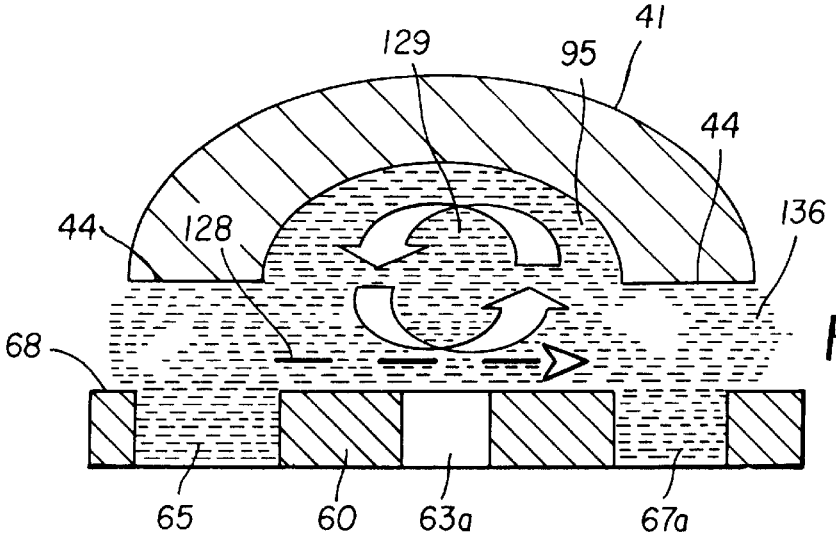
FIG. 13*b* shows a cross-section view of the orifice plate, capillary fluid flow path and cleaning surface of the present invention.

FIG. 13*a* shows a view of outer surface 68 and cleaning surface 41 depicting another embodiment of the present invention. In FIG. 12*a,* cleaning orifice 65, ink jet orifices 63, and drain orifices 67 are shown as hidden lines. In the embodiment of FIGS. 13*a* and 13*b,* the bottom surface of cleaning surface 41 is defined so that the perimeter 44 defines a form that matches the form of outer surface 68. The perimeter 44 is positioned at a distance S from outer surface 68 as described above. However, the portions of bottom surface 68 that are contained within perimeter 44 are maintained at distances that are not necessarily separated from outer surface by the distance S. In FIG. 13*b,* the portions of bottom surface 47 that are within the perimeter 44 define a semicircular chamber 95. Chamber 95 can be used, for example, to provide a vortex 129 flow 128 of cleaning fluid to enhance the cleaning of the outer surface 68 during flow. Chamber 95 can also be used to avoid contact between cleaning member 41 and structures (not shown) that project from outer surface 68.

Figure 13C:
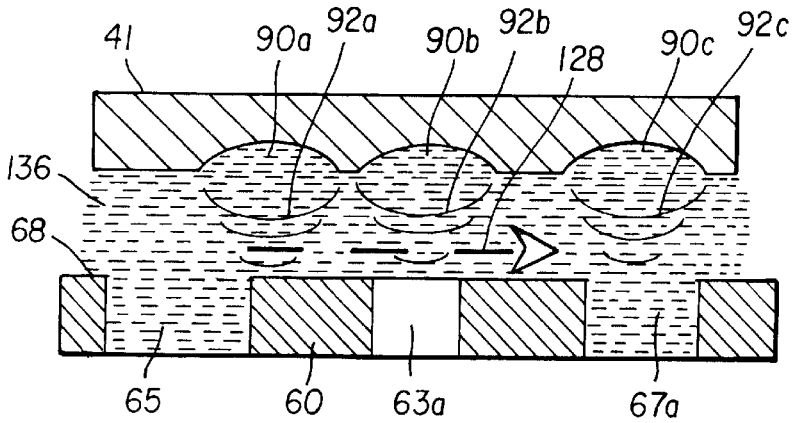
FIG. 13*c* shows a cross-section view of the orifice plate, capillary fluid flow path and cleaning surface of the present invention having wave form surfaces.

In the embodiment of FIG. 13*c,* orifice plate 60, cleaning surface 41 and capillary flow path 48 are shown in cross-section. As can be seen in FIG. 12*c,* cleaning surface 41 includes a set of wave form surfaces 90*a,* 90*b,* and 90*c* defined as recesses in bottom surface 47. During cleaning, actuator 29 oscillates cleaning surface 41 and wave form surfaces 90*a,* 90*b,* and 90*c*. Wave form surfaces 90*a,* 90*b* and 90*c* are shaped to generate focused fluid pressure waves 92*a,* 92*b,* and 92*c* in cleaning fluid 134 to increase the cleaning energy at targeted points on the outer surface 68. As shown, the increased cleaning energy is directed at outer surface 68, the ink jet orifices 63*a* and 63*b,* and drain orifices 67*a* and 67*b*. Such increased cleaning energy cooperates with flow 128 of cleaning fluid 139 to help remove contaminant 80 from outer surface 68.

Figure 14A:
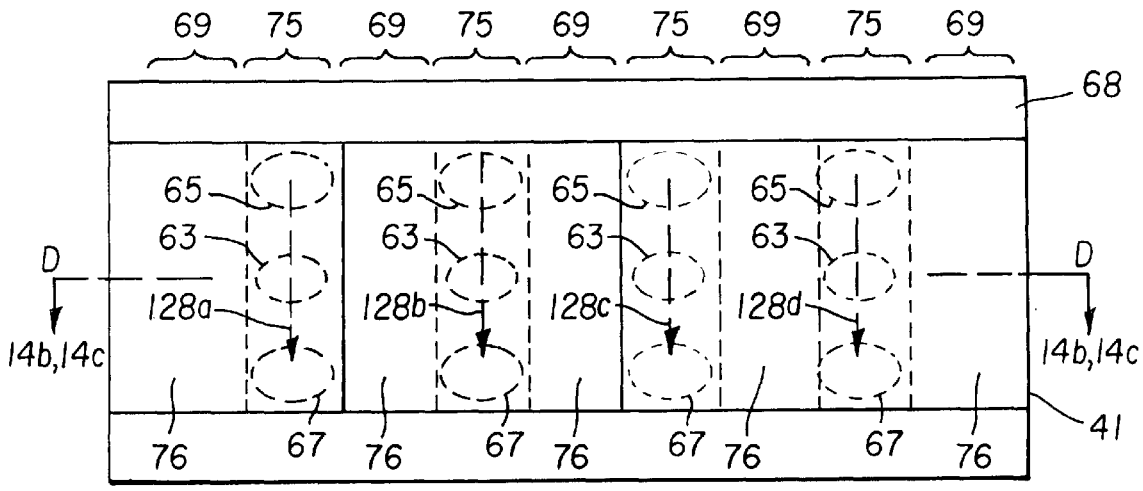
FIG. 14*a* shows an alternative embodiment of the present invention showing the outer surface of the print head and another embodiment of the cleaning surface of the present invention in a cleaning position.

FIG. 14*a* shows an array of ink jet orifices 63. Each ink jet orifice 63 is flanked by a cleaning orifice 65 and a drain orifice 67 to form a cleaning area 75 associated with each ink jet orifice. A space 69 separates each of the cleaning areas 75.

Figure 14B:
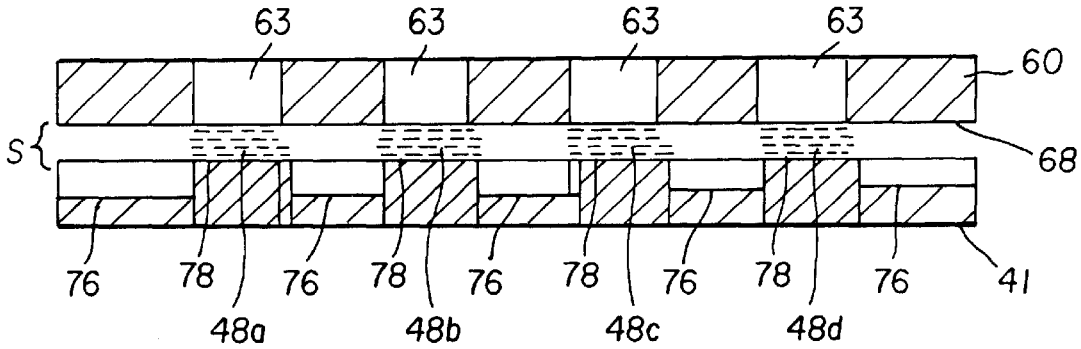
FIG. 14*b* shows a cross-section view of the outer surface, capillary fluid flow path and cleaning surface having a patterned arrangement of cleaning fluid orifices, ink jet orifices and drain orifices and a patterned arrangement of capillary fluid flow paths defined by recesses in the bottom surface of the cleaning surface.

FIG. 14*b* shows a cross section of orifice plate 60, capillary fluid flow paths 48*a,* 48*b,* 48*c,* and 48*d,* and cleaning surface 41. As is shown in FIG. 14*b,* during cleaning, cleaning surface 41 is positioned proximate to outer surface 68 and a cleaning fluid flow path 48 is defined between outer surface 68 and bottom surface 47 of cleaning surface 48. Preferably, each cleaning area 75 defines a separate cleaning fluid flow path 48 along outer surface 68. This can be used where, for example, where it is desirable to separate the different cleaning fluids 134 or ink 114.

It will be recognized that the formation of the plural cleaning fluid flow paths 48*a,* 48*b,* 48*c,* and 48*d* can be accomplished using a number of different embodiments of cleaning surface 41. For example, in FIG. 14*b,* cleaning surface 41 is shown as having a bottom surface 47 with capillary flow surfaces 78 separated from recessed surfaces 76 by way of side walls 77 and 79. Each recessed surface 76 is separated from capillary flow surface 78 to prevent the formation of a fluid bridge between the outer surface 68 and the recessed surface 76. In the embodiment shown in FIG. 14*b,* the recessed surface 76 and side walls 77 and 79 are hydrophobic in order to further resist the formation of a bridge of cleaning fluid between outer surface 68 and recessed surfaces 76. It will be appreciated that side walls 77 and 79 can be joined to capillary flow surfaces 78 with a sharp radius of curvature of about 0.1 microns in order to pin each meniscus 126.

Figure 14C:
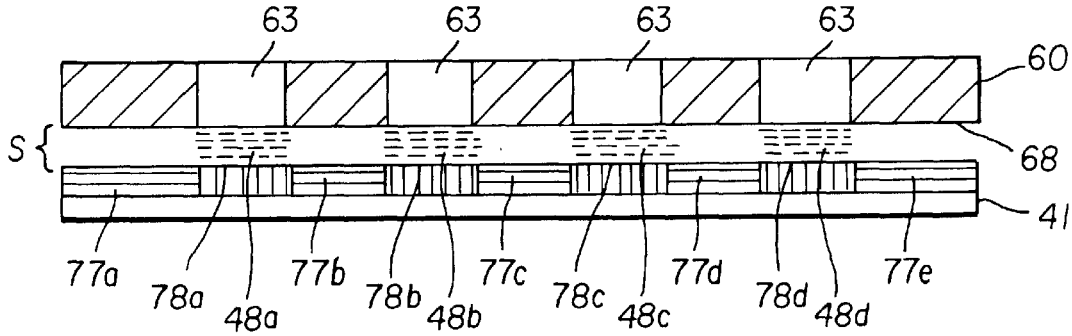
FIG. 14*c* shows a cross-section view of the outer surface, capillary fluid flow path and another embodiment of the cleaning surface having a patterned arrangement of capillary fluid flow paths defined by hydrophilic and hydrophobic areas on the bottom surface of the cleaning surface.

FIG. 14*c* shows another embodiment of cleaning surface 41 wherein separate capillary fluid flow paths 48*a,* 48*b,* 48*c,* and 48*d* are created without the use of recesses. In this embodiment, the bottom surface 47 of cleaning surface 48 comprises alternating hydrophilic and hydrophobic regions. As is shown in FIG. 14*c,* capillary flow surfaces 78*a,* 78*b,* 78*c,* and 78*d* are hydrophilic and are bordered by hydrophobic surfaces 77*a,* 77*b,* 77*c,* 77*d* and 77*e*.

Figure 15A:
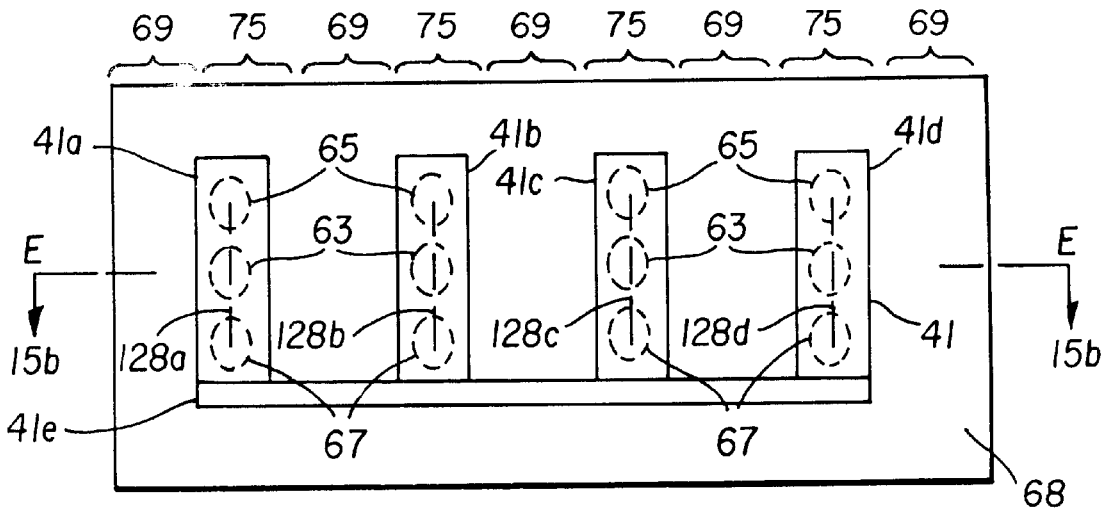
FIG. 15*a* shows an alternative embodiment of the present invention showing the outer surface of the print head and another embodiment of the cleaning surface of the present invention in a cleaning position.

FIG. 15*a* shows a view of outer surface 68 and cleaning surface 41 depicting another embodiment of the present invention. In FIG. 15*a,* cleaning orifice 65, ink jet orifices 63, and drain orifices 67 are shown as hidden lines. In the embodiment of FIG. 15*a,* an array of ink jet orifices 63 is shown. Each ink jet orifice 63 is flanked by a cleaning orifice 65 and a drain orifice 67 to form a cleaning area 75 associated with each ink jet orifice 63. A space 69 separates each of the cleaning areas 75. As is shown in FIG. 13*a,* cleaning member 41 defines a set of separate cleaning surfaces 41*a,* 41*b,* 41*c,* and 41*d*. Each of these surfaces are joined together by a cross member 41*e*. As shown, cross member 41*e* comprises a single cross member connecting cleaning surfaces 41*a,* 41*b,* 41*c* and 41*d* at one end. However, it will be understood that cross member 41*e* can be defined using any number of structures to provide rigid support between the cross members 41*a,* 41*b,* 41*c,* and 41*d*.

Figure 15B:
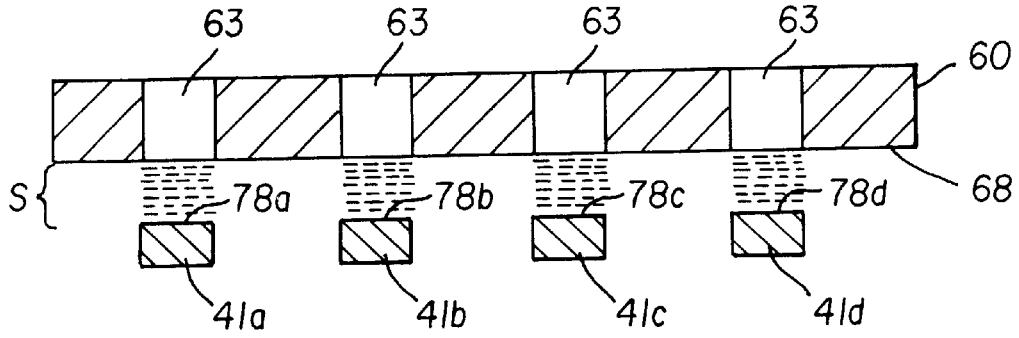
FIG. 15*b* shows a cross-section view of the outer surface, capillary fluid flow path and cleaning surface having a patterned arrangement of cleaning fluid orifices, ink jet orifices and drain orifices and a patterned arrangement of capillary fluid flow paths defined the geometric arrangement of the cleaning surface.

FIG. 15*b* shows a cross section of orifice plate 60, capillary fluid flow paths 48*a,* 48*b,* 48*c* and 48*d,* and cleaning surfaces 41*a,* 41*b,* 41*c,* and 41*d* taken along line E—E in FIG. 14*a*. As is seen in FIGS. 14*a* and 13*b* each of cleaning surfaces 41*a,* 41*b,* 41*c* and 41*d* provides a capillary flow surface 78*a,* 78*b,* 78*c* and 78*d* respectively. When cleaning member 41 is positioned within a distance S from the outer surface 68, capillary fluid flow paths 48*a,* 48*b,* 48*c* and 48*d* are created. This permits flows 128*a,* 128*b,* 128*c* and 128*d* of cleaning fluid 134 to separately flow along outer surface 68.

Figure 16A:
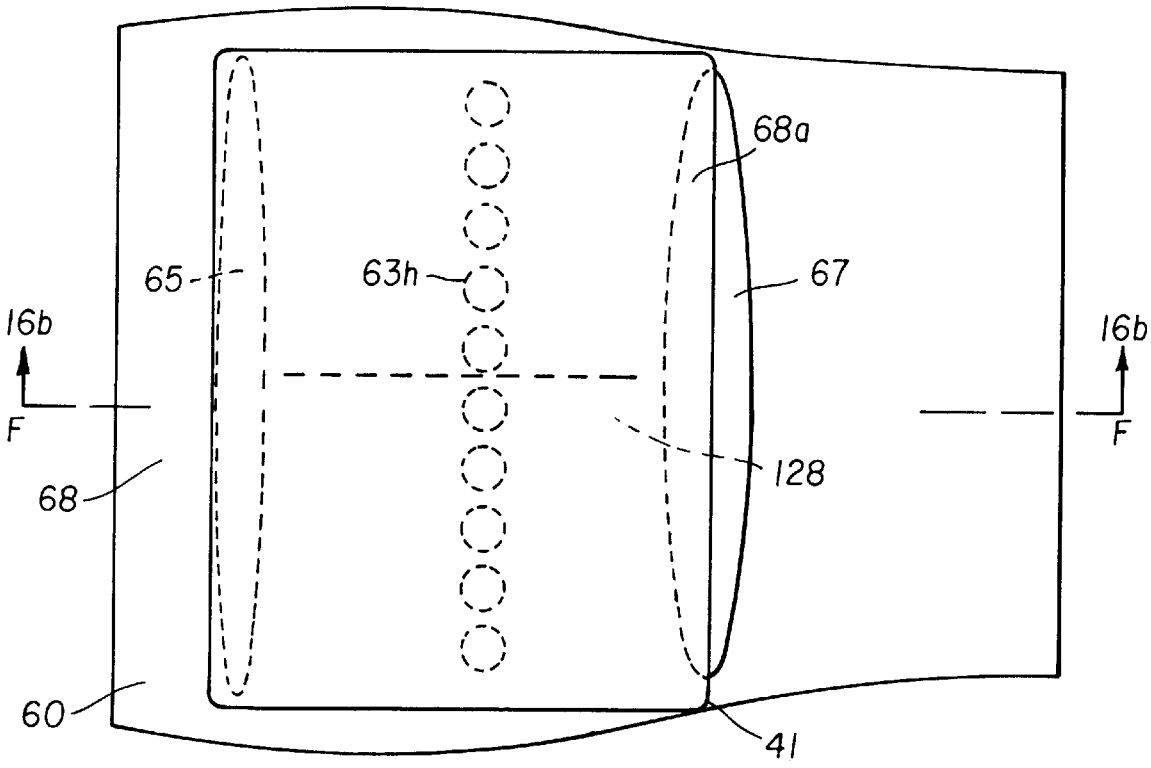
FIG. 16*a* shows another possible embodiments of the present invention wherein an array of ten ink jet orifices are cleaned by a flow of fluid through a single cleaning fluid flow path between one cleaning fluid orifice and one drain orifice.
Figure 16B:
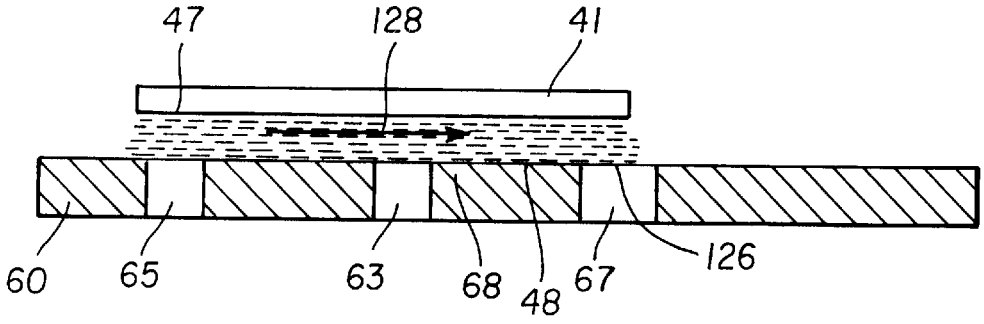
FIG. 16*b* shows a cross-section view of the outer surface, capillary fluid flow path and cleaning surface having a patterned arrangement of cleaning fluid orifices, ink jet orifices and drain orifices and a patterned arrangement of capillary fluid flow paths defined the geometric arrangement of the cleaning surface.

FIGS. 16*a* and 16*b* show another exemplary embodiment of the present invention wherein an array of ten ink jet orifices 63*h* are cleaned by a flow 128 of cleaning fluid 134 from one cleaning orifice 65 and into one drain orifice 67. As is shown in FIG. 16*a,* cleaning fluid orifice 65 is sized to define a flow 128*c* of cleaning fluid 134 across an area of outer surface 68 that includes each ink jet orifices 63*h*. In turn, drain orifice 68 is sized to receive the flow 128*c* of cleaning fluid 134 that flows across such an area. Cleaning surface 41*c* and 70*d* are optionally provided to confine the flow 128*c* of cleaning fluid 134 across the outer surface 68. Alternatively, a gutter (not shown) can be defined in outer surface 68 between the cleaning orifice 65 and the drain fluid orifice, with the side walls of the gutter acting as flow guides.

FIG. 16*b* shows a cross section of the orifice plate 60, capillary flow path 48 and cleaning surface 41 taken along axis F—F. As is shown in FIG. 15*b* cleaning surface 41 is shaped to form a capillary flow path 48 on outer surface 68 that covers cleaning orifice 65, ink jet orifices 63*h* and drain orifice 67. This permits a flow 128 of cleaning fluid 134 to be defined that will clean each of the ink jet orifices 63*h*. As is shown in FIG. 15*a,* cleaning fluid orifice 65 and drain orifice 67 have a linear dimension that is generally co-extensive with the linear distribution of ink jet orifices 63*h*. It will be appreciated that this feature, while useful, is not necessary in this embodiment of the present invention.

FIG. 16*b* also shows another exemplary embodiment of the arrangement of drain orifice 65 and meniscus 126 that is used to help remove a surfactants. Surfactants are materials that tend to float on the cleaning fluid 134 at meniscus 126. Surfactants often trap contaminant 80 thus, it is advantageous to remove surfactants from the meniscus 126 of cleaning fluid 134. To do this, the drain orifice 67 is defined to extend beyond the capillary fluid flow path 48 and the drain orifice 67. The pressure at drain orifice 67 is operated at a pressure that is less than atmospheric pressure. This draws both air and cleaning fluid 134 into drain orifice 67 and draws surfactant and any trapped contaminant 80 into drain orifice 67.

Figure 16C:
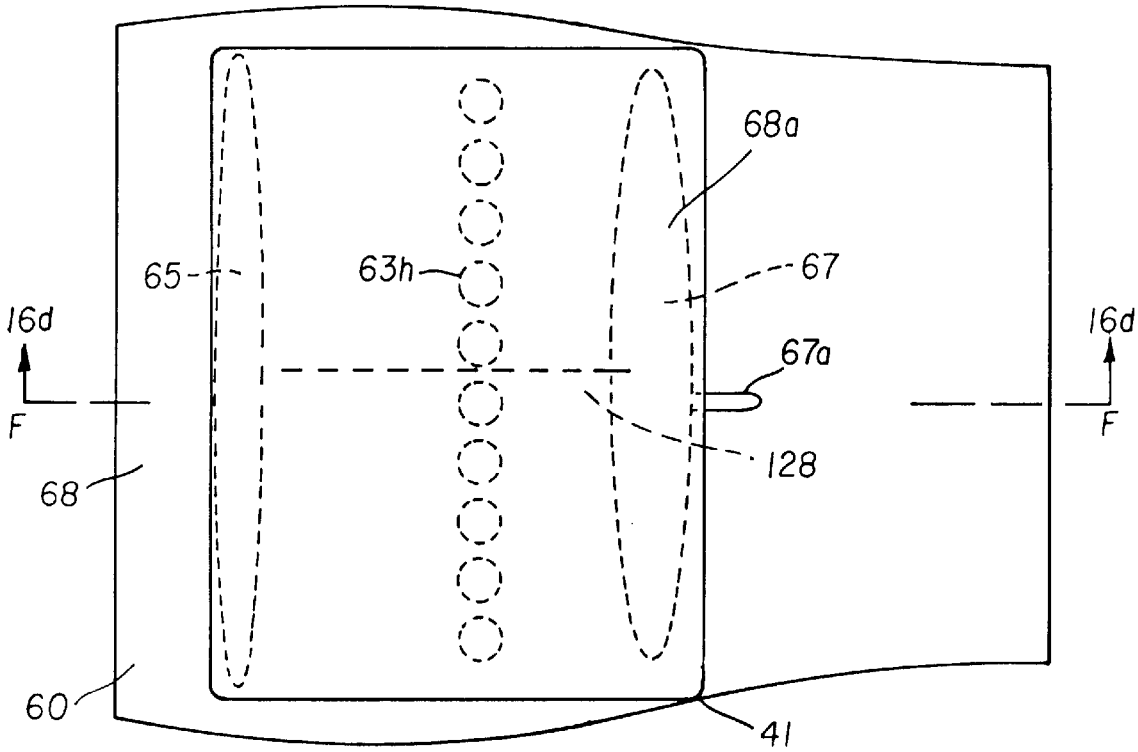
FIG. 16*c* shows another possible embodiment of the present invention having a drain fluid channel.
Figure 16D:
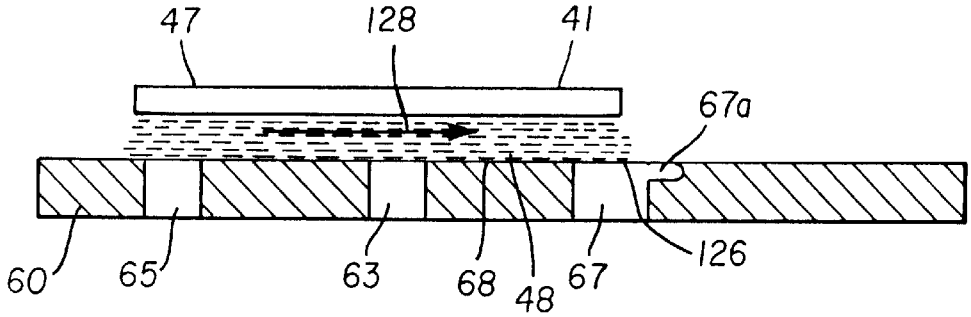
FIG. 16*d* shows a cross section view of the orifice plate capillary flow path and cleaning surface of the present invention.

In FIGS. 16*c* and 16*d* an alternative embodiment of drain orifice 67 is shown operating in cooperation with cleaning surface 41. As is shown in FIGS. 16*c* and 16*d,* drain orifice 67 defines a drain channel 67*a*. Drain channel 67*a* projects away from drain 67 along outer surface 68. During cleaning, cleaning surface 41 is positioned proximate to outer surface 68 so that drain orifice 67 is positioned within the capillary fluid flow path 48. However, drain channel 67*a* projects outside capillary fluid flow path 48. The pressure at drain channel 67*a* is operated at a pressure that is less than atmospheric pressure. This draws air, surfactant and cleaning fluid into drain channel 67*a* and into drain orifice 67.

Figure 17A:
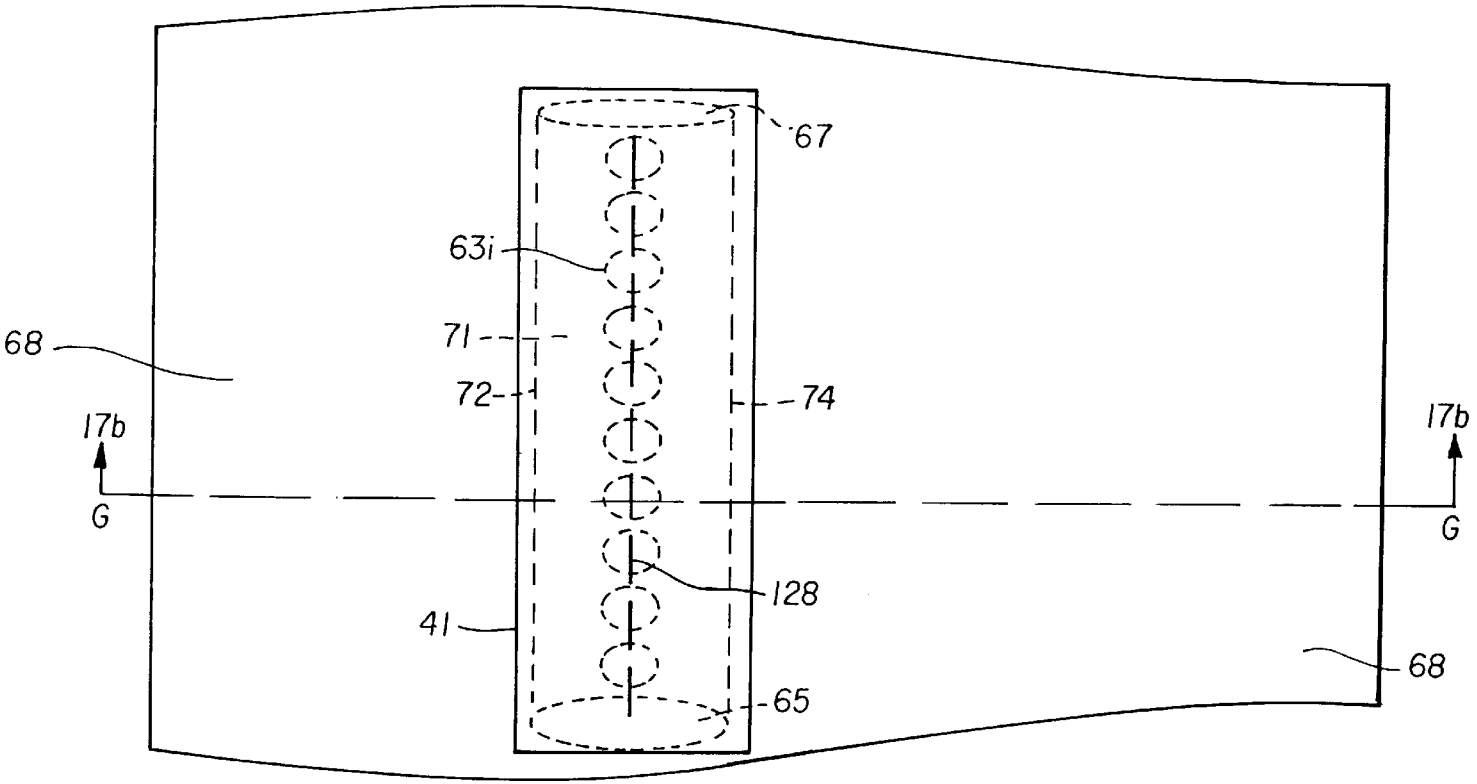
FIG. 17*a* shows another possible embodiment of the present invention wherein an array of ten ink jet orifices are cleaned by a flow of fluid through a single cleaning fluid flow path between one cleaning fluid orifice and one drain orifice.

FIG. 17*a* shows another example embodiment of the present invention wherein an array of ten ink jet orifices 63i are serviced by one cleaning orifice 65 and one drain orifice 67 and a cleaning surface 41. In this embodiment the ink jet orifices are arranged in a linear manner with drain orifice 67 positioned at one end of the array and cleaning orifice 65 positioned at the opposite end. The flow 128 of cleaning fluid 134 cleans the array of ink jet orifices 63*i.* It will be understood that this embodiment can be used in conjunction with either flow guides (not shown) or a gutter, 71, having sidewalls 72 and 74.

Figure 17B:
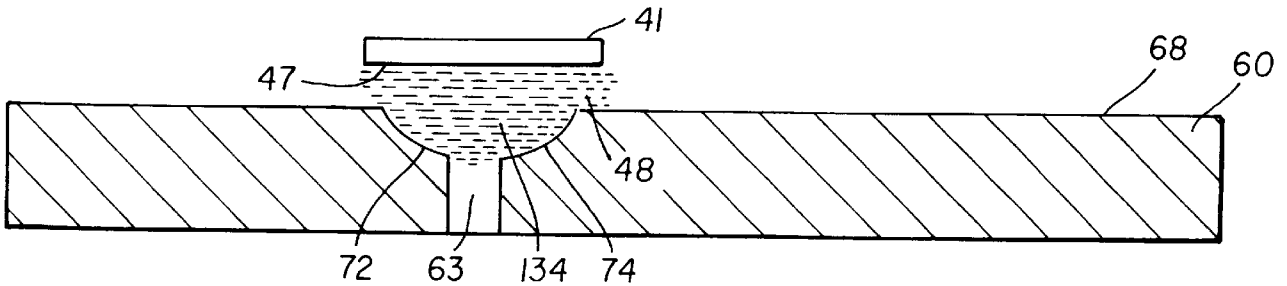
FIG. 17*b* shows a cross-section view of the orifice plate, capillary fluid flow path and cleaning surface having a patterned arrangement of cleaning fluid orifices, ink jet orifices and drain orifices and a capillary fluid flow path.

FIG. 17*b* shows a cross section of the orifice plate 60, capillary flow path 48 and cleaning surface 41 taken along axis G—G. As is shown in FIG. 16*b,* cleaning fluid is deposited into gutter 71 and which is capped by bottom surface 47 of cleaning surface 41. A meniscus 126 of cleaning fluid forms between bottom surface 47 and outer surface 68. This provides a pressurized seal that permits pressurized cleaning fluid to be introduced into gutter 71. It will also be appreciated that the bottom surface 47 of cleaning surface 41 can be defined to form a meniscus 127 with the side walls 72 and 74 of gutter 71.

Figure 18A:
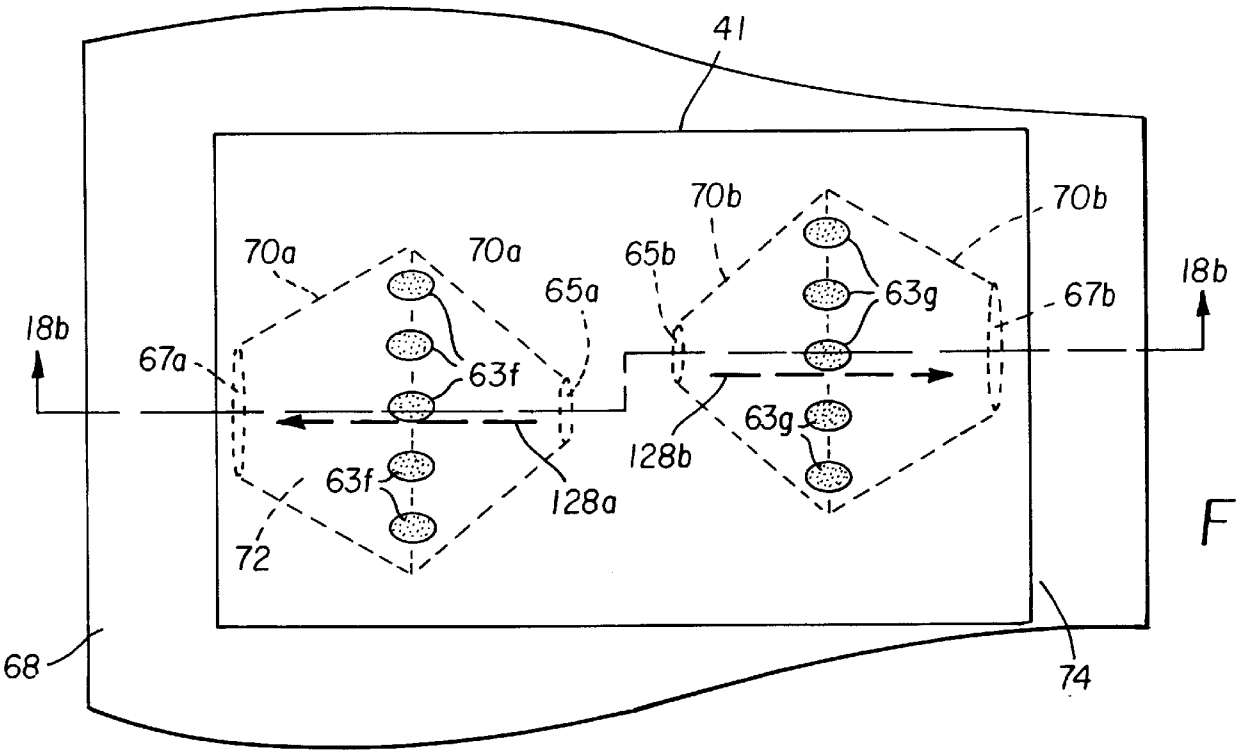
FIG. 18*a* shows another possible embodiment of the present invention wherein an array of ink jet orifices are cleaned by a flow of fluid through cleaning fluid flow paths defined between a cleaning fluid orifice and a drain orifice contained in a recess in the outer surface.
Figure 18B:
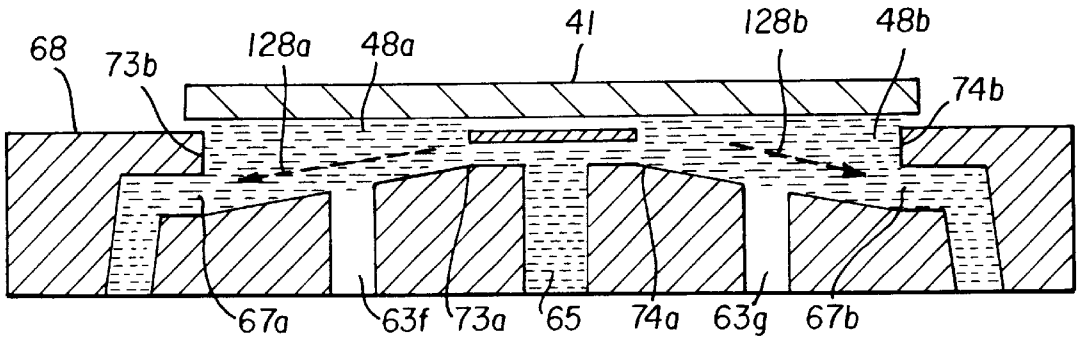
FIG. 18*b* shows a cross-section view of the orifice plate, capillary fluid flow path and cleaning surface having a patterned arrangement of cleaning fluid orifices, ink jet orifices and drain orifices and the capillary fluid flow path.

FIG. 18*a* shows an alternative embodiment of the present invention, wherein the cleaning orifices 65*a* and 65*b,* drain orifice 67*a* and 67*b* and arrays of ink jet orifices 63 and 63*f* are located within recesses 73 and 74 of surface 68. As is shown in FIG. 15*b,* which a cross section of depicts orifice plate 60, capillary flow paths 48*a* and 48*b* and cleaning surface 48 along axis H—H, partitions 70*a* and 70*b* are not defined as projections above outer surface 68, but rather are the sides of recesses 73 and 74 defined in the orifice plate. In this embodiment, arrays of ink jet orifices 63*f* and 63*g* are defined on surfaces 73 and 74 while cleaning orifices 67*a* and 67*b* are defined in the flow guides 73*a* and 74*a* respectively and drain orifices 67*a* and 67*b* are defined at flow guides 73*b* and 74*b* respectively.

The flow 128*a* and 128*b* of cleaning fluid is defined along surfaces 73 and 74 and contained within capillary fluid flow paths 48*a* and 48*b*. This embodiment also protects the array of orifices 63*f* and 63*g* from damage due to incidental contact with objects in the printer 20.

Figure 19A:
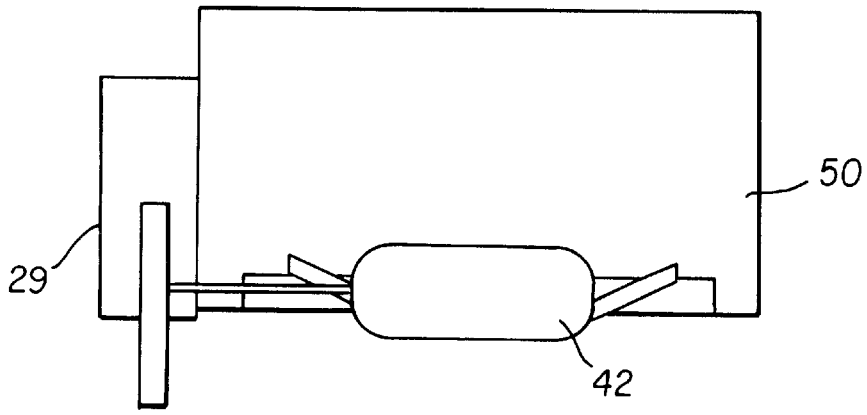
FIG. 19 shows an embodiment of the print head of the present invention with an attached splash guard, actuator and optional ultrasonic transducer.
Figure 19B:
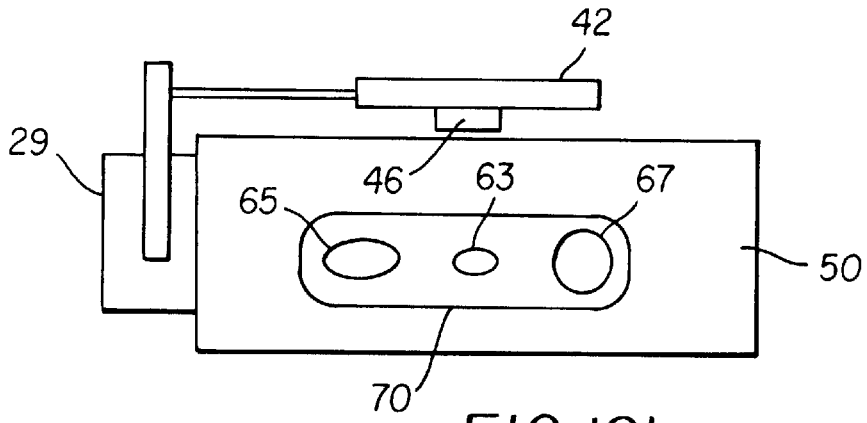
Figure 19C:
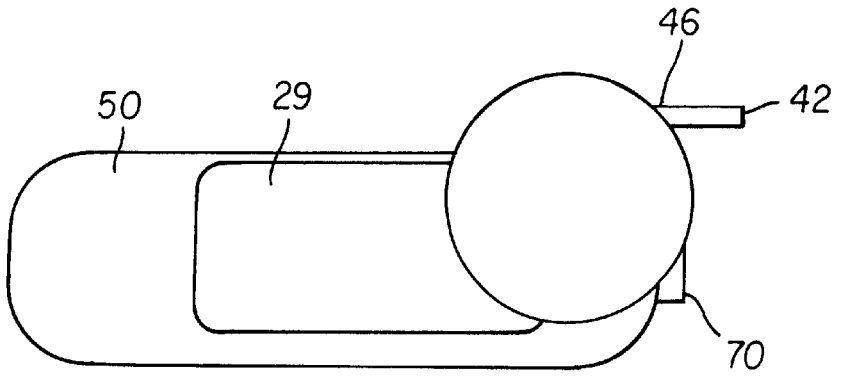

With respect to FIG. 19 what is shown is a top view (FIG. 19*a*), front view (FIG. 19*b*) and side view (FIG. 19*c*) of print head 50 of the present invention having an optional cleaning surface 41 and actuator 29 fixed to the print head body 54. As is shown in FIGS. 19*a,* 19*b* and 19*c,* cleaning surface 41 is retracted during printing operations to a position wherein the cleaning surface 41 does not interfere with the potential flow of ink droplets 58 from the ink jet orifice 63.

Figure 20A:
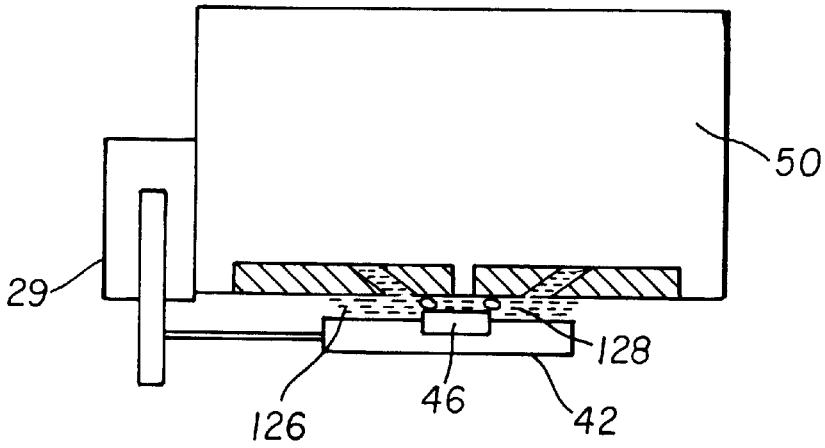
FIG. 20 shows an embodiment of the print head of the present invention having a splash guard, an actuator and an optional ultrasonic transducer wherein the print head comprises a single fluid reservoir and a filter.
Figure 20B:
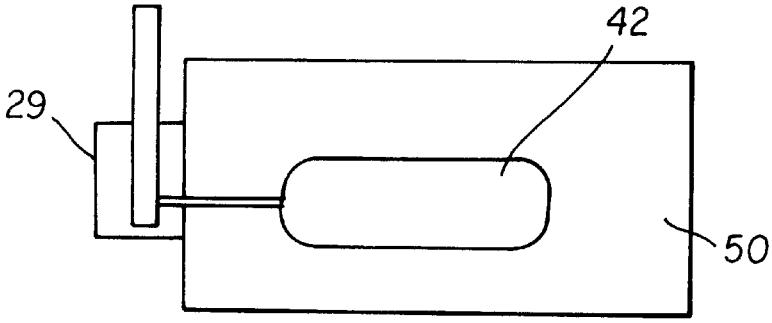
Figure 20C:
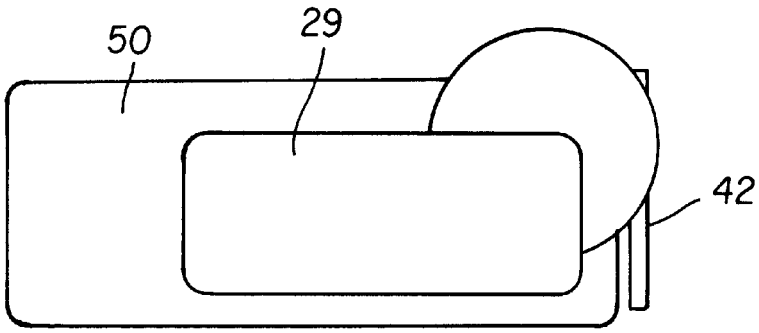

With respect to FIGS. 20*a,* 20*b,* and 20*c,* what is shown is, respectively, top, front and side view of print head 50 of the present invention with cleaning surface 41 and actuator 29 fixed to print head body 54. In this embodiment, cleaning surface 41 is advanced by actuator 29 against cleaning surface 41 forming a meniscus 126. A flow 128 of cleaning fluid 134 is defined between cleaning orifice 65 and drain orifice 63. As is also shown in FIG. 20, an ultrasonic transducer 46 can be fixed to cleaning surface 41 in order to ultrasonically excite the flow 128 of cleaning fluid 134 to enhance the cleaning of the print head orifice 63 and surface 68.

It will be recognized that that the cleaning fluid passageway 66, drain fluid passageway 68 and ink fluid passageway 64 have been shown passing thought the orifice plate 60 at various angles relative to surfaces 61 and 68. It will be recognized that, consistent with the principles of the present invention, the passageways 62, 64 and 66 can take an angular, curved or straight paths between surface 61 and surface 68 as may be dictated by the machining, fabrication, rheology or cost considerations.

It will also be recognized that while the principles of the present invention have been described in association with a print head 50 having a supply of pressurized ink 110 that generates ink droplets 58 using a channel 116*b* or 116*c* that can be squeezed by piezoelectric material 124, the application of this invention is not limited to print heads of this design. In particular, it is understood that one skilled in the art can readily adapt this invention to clean print heads that generate ink droplets of other "on-demand" types such as the thermal "on-demand" type and the continuous type.

The invention has been described in detail with particular reference to certain preferred embodiments thereof, but it will be understood that variations and modifications can be effected within the spirit and scope of the invention.

What is claimed is:

1. A self-cleaning print head, comprising:

a print head body having an orifice plate defining an ink jet orifice, a cleaning orifice and a drain orifice, and said orifice plate further defining an outer surface between the orifices;

a source of pressurized cleaning fluid connected to the cleaning orifice;

a fluid return connected to the drain orifice, and a cleaning surface disposed proximate to and separate from the outer surface to define a capillary fluid flow path from the cleaning orifice across the ink jet orifice and to the drain orifice;

wherein, during cleaning, the source of pressurized cleaning fluid discharges a flow of a cleaning fluid into the capillary flow path and pressurized cleaning fluid from the capillary flow path passes through the drain orifice and into the fluid return.

2. The self-cleaning print head of claim 1, wherein the fluid return comprises a drain pump to draw cleaning fluid from capillary fluid flow path during cleaning operations.

3. The self-cleaning print head of claim 1, wherein during cleaning, the cleaning fluid pressure at the cleaning orifice is at a first level and the cleaning fluid pressure level at the drain orifice is at a second, lower level.

4. The self-cleaning print head of claim 3, wherein during cleaning, the fluid pressure level at the drain orifice is positive.

5. The self-cleaning print head of claim 1, wherein the cleaning fluid pressure level differential between the cleaning fluid pressure at the cleaning fluid orifice and the cleaning fluid pressure at the drain orifice is between 0.5 and 1.5 psi.

6. The self-cleaning print head of claim 1, wherein the cleaning surface defines a continuous perimeter and the continuous perimeter is positioned at a distance between 0.1 and 100 mircrons from the outer surface during cleaning.

7. The self-cleaning print head of claim 1, wherein the cleaning surface defines a continuous perimeter and the continuous perimeter is positioned at a distance from the outer surface that is no greater than a diameter of the ink jet orifice.

8. The self-cleaning print head of claim 7 wherein the cleaning surface defines a cavity region within the continuous perimeter and wherein a separation between the cavity region and the continuous perimeter is no greater than ten times larger than the separation defined between the continuous perimeter and the outer surface.

9. The self-cleaning print head of claim 1, wherein the cleaning surface defines a continuous perimeter and wherein during cleaning the continuous perimeter is positioned at a distance that is less than the product of the surface tension of the cleaning fluid multiplied by two and divided by the desired maximum fluid pressure in the cleaning fluid within the perimeter.

10. The self-cleaning print head of claim 1 further comprising at least one additional ink jet orifice wherein the cleaning surface defines a capillary fluid flow path between the cleaning orifice, each ink jet orifice and the drain orifice.

11. The self-cleaning print head of claim 1, wherein said print head comprises an orifice plate defining at least one additional ink jet orifice, at least one additional cleaning orifice and at least one additional drain orifice, and wherein said cleaning surface forms a capillary fluid flow path from the cleaning fluid orifices across the outer surface, over each of the ink jet orifices and into the drain orifices.

12. The self-cleaning print head of claim 1 wherein a patterned arrangement of recesses guides the flow of cleaning fluid through the capillary fluid flow path.

13. The self-cleaning print head of claim 12, wherein each recess has a hydrophobic surface.

14. The self-cleaning print head of claim 1, wherein a patterned arrangement of hydrophilic areas on the cleaning surface further defines the capillary fluid flow path.

15. The self-cleaning print head of claim 1, wherein a patterned arrangement of hydrophobic areas on the cleaning surface further defines the capillary fluid flow path.

16. The self-cleaning print head of claim 1, wherein a patterned arrangement of hydrophobic surfaces on the outer surface further defines the capillary fluid flow path.

17. The self-cleaning print head of claim 1, wherein a patterned arrangement of hydrophilic areas on the outer surface further defines the capillary fluid flow path.

18. The self-cleaning print head of claim 1, further comprising an actuator for moving the cleaning surface into a proximate and separate position with the outer surface.

19. The self-cleaning print head of claim 18 wherein said actuator is operated to oscillate the cleaning surface to excite a flow of cleaning fluid during cleaning.

20. The self-cleaning print head of claim 1, further comprising an oscillator fixed to the cleaning surface to excite the flow of cleaning fluid during cleaning.

21. The self-cleaning print head of claim 1, wherein said cleaning surface comprises a patterned arrangement of wave forms to induce focused pressure at the outer surface.

22. The self-cleaning print head of claim 1, wherein the capillary fluid flow path defines an air-liquid interface where said interface is positioned at the drain orifice.

23. The self-cleaning print head of claim 1, wherein the drain orifice defines a shaped channel and the capillary fluid flow path defines an air to fluid interface at the shaped channel.

24. A self-cleaning print head, comprising:

a print head body having an orifice plate defining an ink jet orifice and a drain orifice, and said orifice plate further defining an outer surface between the orifices;

a source of pressurized ink connected to the ink jet orifice;

a fluid return connected to the drain orifice; and a cleaning surface disposed proximate to and separate from the outer surface to define a capillary fluid flow path from the ink jet orifice and to the drain orifice;

wherein, during cleaning, the source of pressurized ink discharges a flow of ink into the capillary flow path and pressurized ink from the capillary flow path passes through the drain orifice and into the fluid return.

25. A self-cleaning printer, comprising:

a print head having an orifice plate defining an ink jet orifice, a cleaning orifice and a drain orifice, and said orifice plate further defining an outer surface between the orifices;

a source of pressurized cleaning fluid connected to the cleaning orifice;

a fluid return connected to the drain orifice, and a cleaning surface disposed proximate to and separate from the outer surface to define a capillary fluid flow path from the cleaning orifice across the ink jet orifice and to the drain orifice;

wherein, during cleaning, the source of pressurized cleaning fluid discharges a flow of a cleaning fluid into the capillary flow path and pressurized cleaning fluid from the capillary flow path passes through the drain orifice and into the fluid return.

26. The self-cleaning printer of claim 25, wherein the fluid return comprises a drain pump to draw cleaning fluid from capillary fluid flow path during cleaning operations.

27. The self-cleaning printer of claim 25, wherein during cleaning, the cleaning fluid pressure at the cleaning orifice is at a first level and the cleaning fluid pressure level at the drain orifice is at a second, lower level.

28. The self-cleaning printer of claim 27, wherein during cleaning, the fluid pressure level at the drain orifice is positive.

29. The self-cleaning printer of claim 25, wherein the cleaning fluid pressure level differential between the cleaning fluid pressure at the cleaning fluid orifice and the cleaning fluid pressure at the drain orifice is between 0.5 and 1.5 psi.

30. The self-cleaning printer of claim 25, wherein the cleaning surface defines a continuous perimeter and the continuous perimeter is positioned at a distance between 0.1 and 100 microns from the outer surface during cleaning.

31. The self-cleaning printer of claim 30, wherein the cleaning surface defines a cavity region within the continuous perimeter and wherein a separation between the cavity region and the continuous perimeter is no greater than ten times larger than the separation defined between the continuous perimeter and the outer surface.

32. The self-cleaning printer of claim 25, wherein the cleaning surface defines a continuous perimeter and the continuous perimeter is positioned at a distance from the outer surface that is no greater than a diameter of the ink jet orifice.

33. The self-cleaning printer of claim 25, wherein the cleaning surface defines a continuous perimeter and wherein during cleaning the continuous perimeter is positioned at a distance that is less than a product of a surface tension of the cleaning fluid multiplied by two and divided by a desired maximum fluid pressure in the cleaning fluid within the perimeter.

34. The self-cleaning printer of claim 25 further comprising at least one additional ink jet orifice wherein the cleaning surface defines a capillary fluid flow path between the cleaning orifice, each ink jet orifice and a drain orifice.

35. The self-cleaning printer of claim 25, wherein said print head comprises an orifice plate defining at least one additional drain orifice, at least one additional cleaning orifice and at least one additional drain orifice, and wherein said cleaning surface forms a capillary fluid flow path from the cleaning fluid orifices across the outer surface, over each of the ink jet orifices and into the drain orifices.

36. The self-cleaning printer of claim 25 wherein a patterned arrangement of recesses guides the flow of cleaning fluid through the capillary fluid flow path.

37. The self-cleaning printer of claim 36, wherein each recess has a hydrophobic surface.

38. The self-cleaning printer of claim 25, wherein a patterned arrangement of hydrophilic areas on the cleaning surface further defines the capillary fluid flow path.

39. The self-cleaning printer of claim 25, wherein a patterned arrangement of hydrophobic areas on the cleaning surface further defines the capillary fluid flow path.

40. The self-cleaning printer of claim 25, wherein a patterned arrangement of hydrophobic surfaces on the outer surface further defines the capillary fluid flow path.

41. The self-cleaning printer of claim 25, wherein a patterned arrangement of hydrophilic areas on the outer surface further defines the capillary fluid flow path.

42. The self-cleaning printer of claim 25, further comprising an actuator for moving the cleaning surface into a proximate and separate position with the outer surface.

43. The self-cleaning printer of claim 42, wherein said actuator is operated to oscillate the cleaning surface to excite a flow of cleaning fluid during cleaning.

44. The self-cleaning printer of claim 25, further comprising an oscillator fixed to the cleaning surface to excite the flow of cleaning fluid during cleaning.

45. The self-cleaning printer of claim 25, wherein said cleaning surface comprises a patterned arrangement of wave forms to induce focused pressure at the outer surface.

46. The self-cleaning printer of claim 25, wherein the capillary fluid flow path defines an air-liquid interface where said interface is positioned at the drain orifice.

47. The self-cleaning printer of claim 25, wherein the drain orifice defines a shaped channel and the capillary fluid flow path defines an air to fluid interface at the shaped channel.

48. A self-cleaning printer, comprising:

a print head having an orifice plate defining an ink jet orifice and a drain orifice, and said orifice plate further defining an outer surface between the orifices;

a source of pressurized ink connected to the ink jet orifice;

a fluid return connected to the drain orifice; and a cleaning surface disposed proximate to and separate from the outer surface to define a capillary fluid flow path from the cleaning orifice across the ink jet orifice and to the drain orifice;

wherein, during cleaning, the source of pressurized ink discharges a flow of ink into the capillary flow path and pressurized ink from the capillary flow path passes through the drain orifice and into the fluid return.

49. A method for cleaning an outer surface and ink jet orifices of a print head having a cleaning fluid orifice and a drain orifice defined on the outer surface, and further having a cleaning surface, a pressurized supply of a cleaning fluid connected to the cleaning orifice and a drain reservoir connected to the drain orifice, the method comprising the steps of:

moving the cleaning surface into a proximate and separate position over a portion of the outer surface of the print head to form a capillary fluid flow path between the outer surface and the cleaning surface in an area of the outer surface encompassing a cleaning orifice, a drain orifice and an ink jet orifice;

discharging a pressurized flow of cleaning fluid into the capillary fluid flow path to form a bridge of a cleaning fluid between the cleaning surface, the outer surface, the cleaning orifice, the ink jet orifice and the drain orifice and;

defining a pressurized flow of a cleaning fluid through the bridge from the supply of cleaning fluid to the drain.

50. The method of claim 49, further comprising the step of vacuuming cleaning fluid from the drain orifice and into the drain reservoir.

51. The method of claim 49 further comprising the step of introducing vibrations in the cleaning fluid.

52. The method of claim 49 further comprising the step of introducing vibrations in the cleaning fluid.

* * * * *